US010160133B2

(12) United States Patent
Hauser et al.

(10) Patent No.: US 10,160,133 B2
(45) Date of Patent: Dec. 25, 2018

(54) MANDOLINE SLICER

(71) Applicant: Progressive International Corporation, Kent, WA (US)

(72) Inventors: Lawrence M. Hauser, Auburn, WA (US); Joshua Stewart, Seattle, WA (US); Justin Bagley, Seattle, WA (US); Sascha Kaposi, Tacoma, WA (US)

(73) Assignee: Progressive International Corporation, Kent, WA (US)

( * ) Notice: Subject to any disclaimer, the term of this patent is extended or adjusted under 35 U.S.C. 154(b) by 188 days.

(21) Appl. No.: 14/679,373

(22) Filed: Apr. 6, 2015

(65) Prior Publication Data

US 2015/0209973 A1 Jul. 30, 2015

Related U.S. Application Data

(63) Continuation-in-part of application No. 14/340,128, filed on Jul. 24, 2014, which is a continuation-in-part
(Continued)

(51) Int. Cl.
*B26D 1/02* (2006.01)
*B26D 3/28* (2006.01)
(Continued)

(52) U.S. Cl.
CPC ..... *B26D 7/2628* (2013.01); *B26D 3/283* (2013.01); *B26D 2001/006* (2013.01);
(Continued)

(58) Field of Classification Search
CPC ..... B26D 3/283; B26D 2003/285–2003/288; Y10T 83/9493; Y10T 83/9498; A47J 43/25
(Continued)

(56) References Cited

U.S. PATENT DOCUMENTS 2,328,887 A 9/1943 Arney
2,519,409 A * 8/1950 Strassenburg ..... B26D 3/18 83/404.1
(Continued)

FOREIGN PATENT DOCUMENTS

CH WO 9524995 A1 * 9/1995 ..... A47J 43/25
DE 1629975 B * 3/1976 ..... A47J 43/25
(Continued)

OTHER PUBLICATIONS

WO 9524995 A1 english translation; Sep. 1995 Schlund Manfred A47J43/25.*
(Continued)

*Primary Examiner* — Laura M Lee
(74) *Attorney, Agent, or Firm* — Lowe Graham Jones PLLC

(57) ABSTRACT

A mandoline slicer includes a slicing blade between a runout ramp and a platen defining an adjustable slicing ramp. A set of cubing blades is selectively movable between extended and retracted positions, extendable through slots formed in the runout ramp. A pusher is configured for 90 degree rotational movement to allow perpendicular cutting by the cubing blades before slicing by a main blade.

20 Claims, 35 Drawing Sheets

Related U.S. Application Data of application No. 13/367,952, filed on Feb. 7, 2012, now Pat. No. 8,839,702.

(60) Provisional application No. 61/935,751, filed on Feb. 4, 2014, provisional application No. 61/440,691, filed on Feb. 8, 2011.

(51) Int. Cl.
*B26D 7/26* (2006.01)
*B26D 1/00* (2006.01)

(52) U.S. Cl.
CPC ..... *B26D 2001/0066* (2013.01); *B26D 2003/287* (2013.01); *B26D 2003/288* (2013.01); *Y10S 83/932* (2013.01); *Y10T 83/9488* (2015.04); *Y10T 83/9493* (2015.04); *Y10T 83/9498* (2015.04)

(58) Field of Classification Search
USPC ..... 83/856, 932
See application file for complete search history.

(56) References Cited

U.S. PATENT DOCUMENTS

| | | | | |
|---|---|---|---|---|
| 3,495,639 | A * | 2/1970 | Johansson | B26D 1/25 241/95 |
| 4,038,892 | A | 8/1977 | Popeil | |
| 4,120,089 | A | 10/1978 | Börner | |
| 4,570,519 | A | 2/1986 | Motosko, II | |
| 4,733,588 | A | 3/1988 | Yamamoto | |
| 6,082,645 | A | 7/2000 | Himmighofen et al. | |
| 7,066,071 | B2 | 6/2006 | Zeder et al. | |
| 7,143,677 | B2 | 12/2006 | Zeder et al. | |
| 7,621,207 | B2 | 11/2009 | Botsai et al. | |
| 7,726,221 | B2 * | 6/2010 | Tweg | B26D 3/18 83/36 |
| 8,181,560 | B2 | 5/2012 | Hauser et al. | |
| 2002/0174754 | A1 | 11/2002 | Vincent | |
| 2004/0031158 | A1 | 2/2004 | Boerner | |
| 2004/0231482 | A1 | 11/2004 | Boilen | |
| 2006/0075872 | A1 | 4/2006 | Wangler | |
| 2006/0081108 | A1 | 4/2006 | de Buyer | |
| 2006/0123639 | A1 | 6/2006 | Boerner | |
| 2006/0283299 | A1 | 12/2006 | Mellen et al. | |
| 2007/0062349 | A1 | 3/2007 | Ishii | |
| 2007/0125207 | A1 | 6/2007 | Lucas et al. | |
| 2007/0137457 | A1 | 6/2007 | Botsai et al. | |
| 2008/0098866 | A1 | 5/2008 | DiPietro | |
| 2011/0067545 | A1 | 3/2011 | Robbins | |
| 2011/0094111 | A1 * | 4/2011 | Hauser | B26D 3/283 30/286 |
| 2011/0154998 | A1 * | 6/2011 | Wong | B26D 3/283 99/537 |
| 2012/0198980 | A1 | 8/2012 | Bagley | |
| 2012/0227564 | A1 | 9/2012 | Fung | |

FOREIGN PATENT DOCUMENTS

| | | | | |
|---|---|---|---|---|
| DE | 3337201 | * | 5/1985 | B26D 1/02 |
| DE | 8500705 | U1 | 11/1987 | |
| DE | 20318619 | | 2/2005 | |
| DE | 602005001749 | | 9/2007 | |
| DE | 202009009557 | U1 | 10/2009 | |
| DE | 102009030851 | A1 | 12/2010 | |
| EP | 1798010 | A2 | 6/2007 | |
| EP | 2484499 | A2 | 8/2012 | |
| GB | 530154 | A | 12/1940 | |
| GB | 1599694 | | 10/1981 | |
| GB | 2313771 | A | 12/1997 | |
| WO | 2009103255 | A1 | 8/2009 | |

OTHER PUBLICATIONS

"Easy Slice 2, Folding Mandoline," Zyliss Swiss Innovation, pp. 6, printed May 18, 2009.

* cited by examiner

FIG. 35
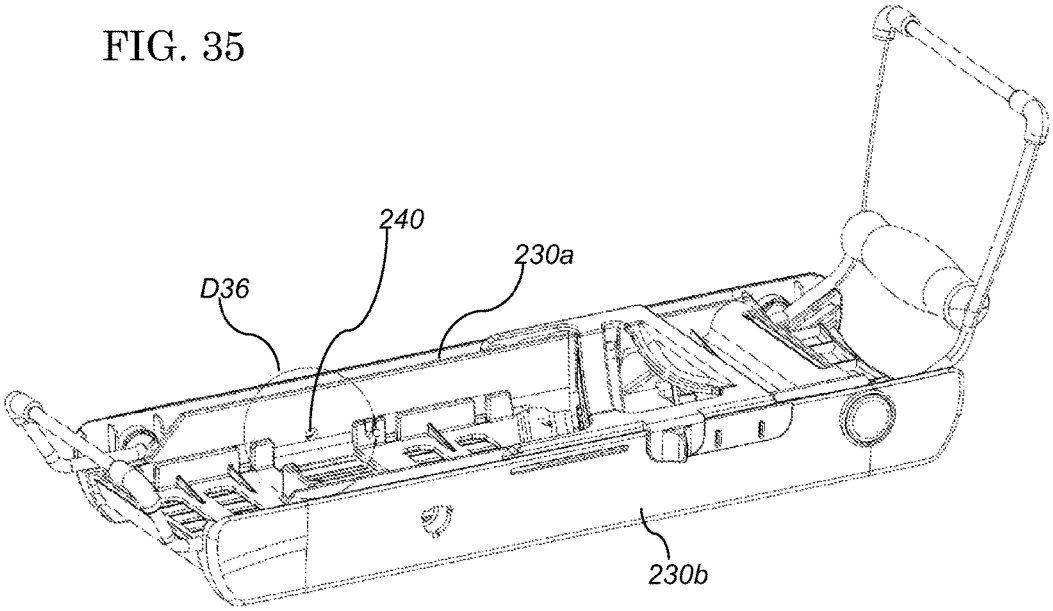
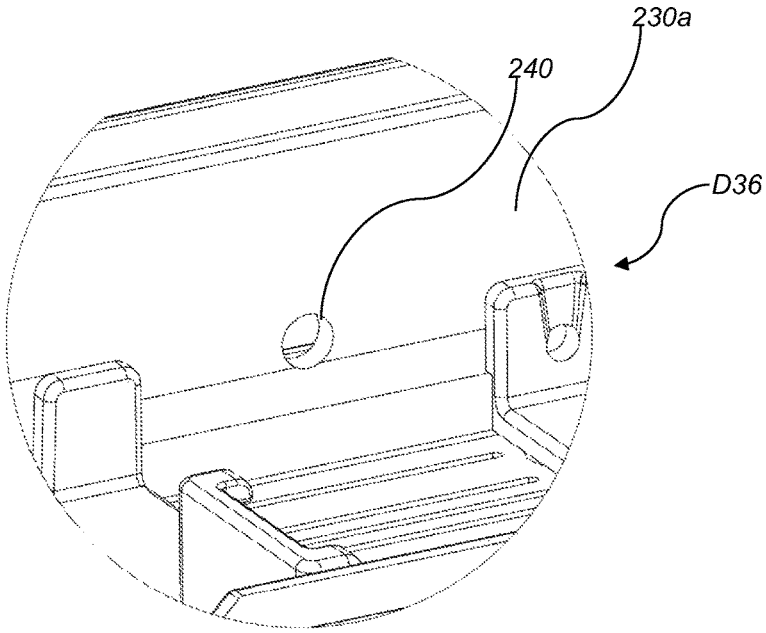
FIG. 36

MANDOLINE SLICER

PRIORITY CLAIM

This application is a continuation in part of U.S. application Ser. No. 14/340,128 filed Jul. 24, 2014, which is a continuation in part of U.S. application Ser. No. 13/367,952 filed Feb. 7, 2012, which claims the benefit of provisional application Ser. No. 61/440,691 filed Feb. 8, 2011, and this application further claims the benefit of provisional application Ser. No. 61/935,751 filed Feb. 4, 2014, the contents of each of which are incorporated by reference.

FIELD OF THE INVENTION

This invention generally relates to mandoline-type slicing devices.

BACKGROUND OF THE INVENTION

Mandoline slicers have been in use for many years, but existing slicers are lacking in one respect or another. Many have slicing guards that are difficult to use or which do not readily follow the path of the slicing tray, leading users to omit them altogether. Consumer slicers are also difficult to adjust and cannot readily be used for a variety of slicing and grating tasks. The typical mandoline slicer is a unitask device that is infrequently used because of its limitations.

SUMMARY OF THE INVENTION

The mandoline slicer as described more fully below includes a slicing blade fixed to a blade tray, with a hand guard positioned for sliding movement over the tray.

In preferred versions of the invention, the slicing blade is adjustable, preferably in a stepped fashion using an adjustment knob indicating particular slicing depths.

Some versions may further include a series of julienne blades that may be retracted below the blade tray when not in use, and selectively extended above the blade tray when in use. As food items are passed over the slicing blade and julienne blades, the food items are cut into thin strips.

A preferred hand guard is secured to one side of the slicer, mounted in a channel formed along one sidewall. The hand guard may be pivoted into an open position to receive the food item to be sliced, and pivoted into a closed position. A series of magnets or other means may be used to retain the slicing guard against the tray.

In a version of the invention, two sets of julienne blades are provided, with both sets being extendable or retractable.

In a version of the invention, more than one slicing blade is provided in a manner in which the multiple slicing blades are selectable by a user.

In some versions of the invention, one or more sets of cubing blades may be incorporated into the slicer, preferably in the form of retractable blades positioned on the runout plate.

Yet other versions of the invention include additional features, as described below with respect to the preferred embodiments.

BRIEF DESCRIPTION OF THE DRAWINGS

Preferred and alternative examples of the present invention are described in detail below with reference to the following drawings:

FIG. 35 is a bottom perspective view of the slicer of FIG. 30, indicating detail D36.

FIG. 36 is a close-up view of detail D36 as indicated in FIG. 35.

DETAILED DESCRIPTION OF THE PREFERRED EMBODIMENT

Figure 1:
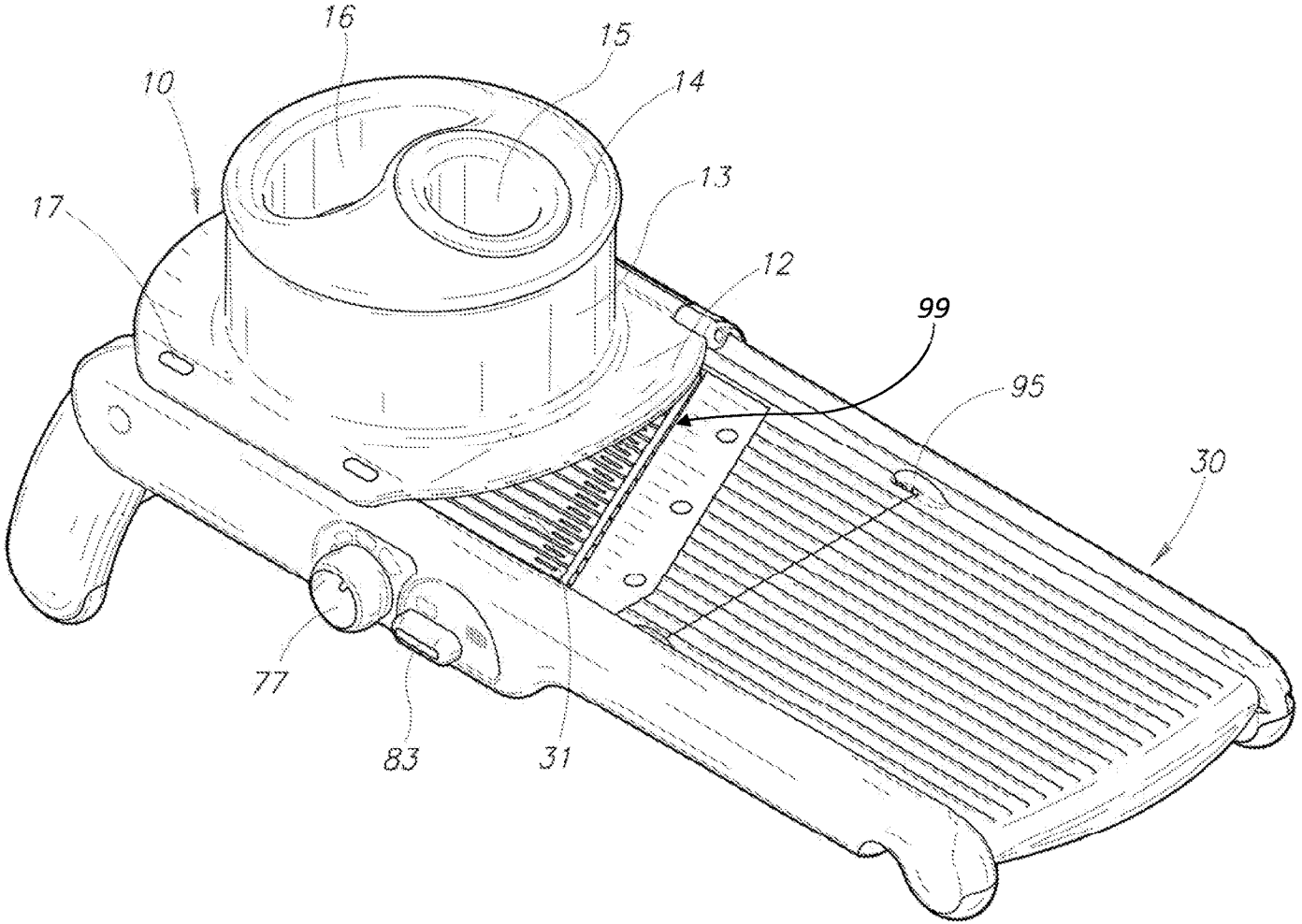
FIG. 1 is a top perspective view of a preferred version of the mandoline slicer, shown with a slicing guard attached.
Figure 2:
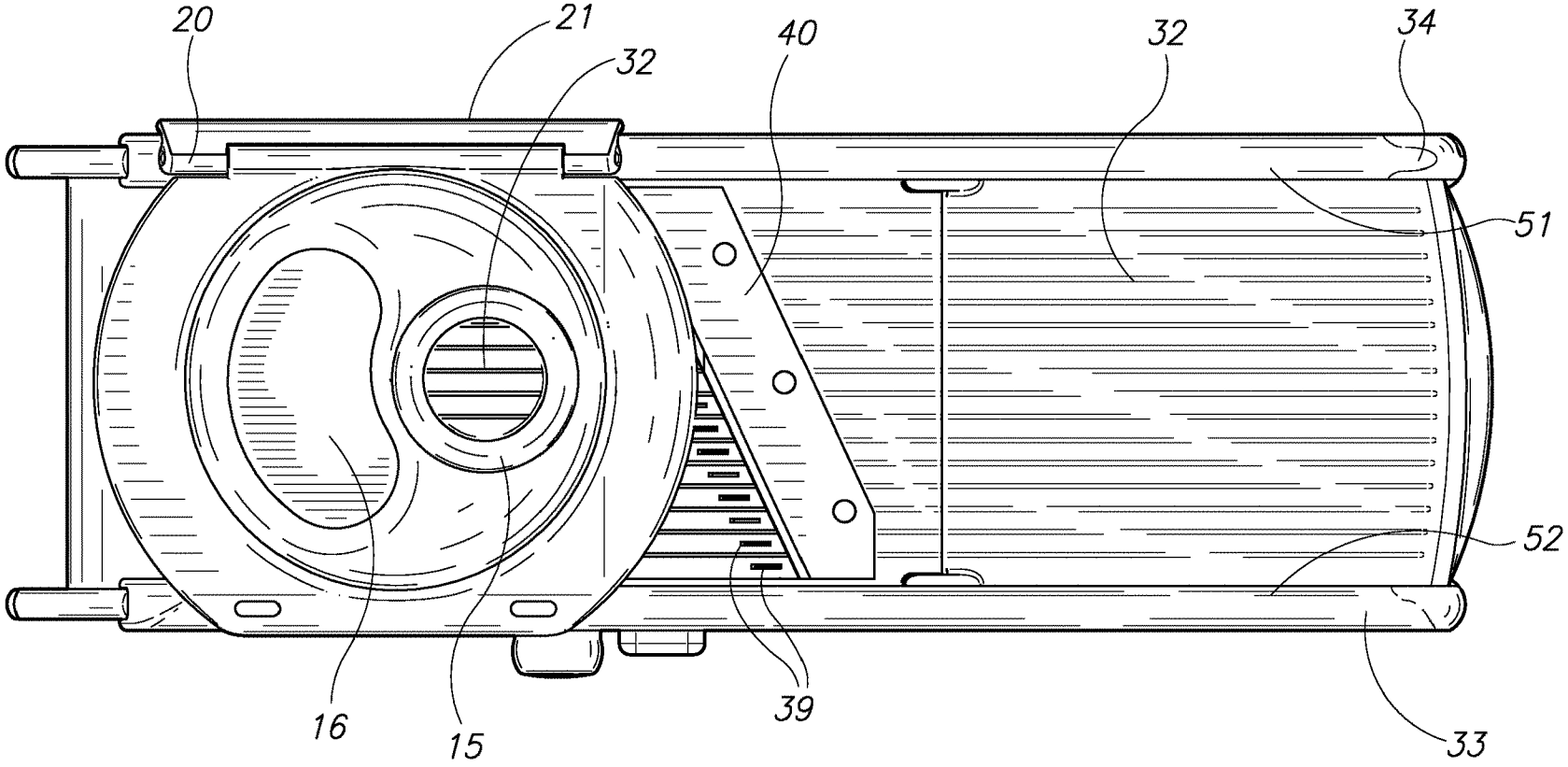
FIG. 2 is a top plan view of a preferred mandoline slicer.

The preferred mandoline slicer as illustrated in FIGS. 1 and 2 includes a hand guard 10 that is configured to slide along a ramp 30 toward a slicing blade 40. In accordance with various preferred aspects of the invention, the ramp may be formed in two sections, including a proximal first section 31 lying beneath the hand guard 10 in FIGS. 1 and 2 and leading toward the slicing blade, and a distal second section 32 extending away from the slicing blade. A gap is defined between the two ramp portions to allow the two portions to be adjusted upward or downward with respect to one another. The first section is adjustable to varying heights below the level of the slicing blade in order to vary the thickness of the slices produced.

The hand guard is formed with a wide flange 12 surrounding a generally cylindrical grip pillar 13. The pillar 13 is hollow at its center and receives a mating cylindrical insert 14. The insert 14 has a bottom end with a series of spikes 18 (see FIGS. 3A and 7) or a similar gripping surface configured to hold a food item in order to slide it along the ramp and toward the blade. The insert is moveable upward and downward within the pillar in order to continue to move downward toward the ramp as a food item is sliced multiple times.

The insert 14, in the example of the invention as shown, includes a bore 15 extending through the insert so that a long food item such as a carrot can be positioned through the bore and into the blade while an opposite end of the food item may extend through the insert, as best seen in the top view of FIG. 2. The vertical sidewalls of the bore may optionally include a series of ridges to reduce friction between the food item and the sidewalls. The insert further may include a finger cup 16, which in the preferred version is sized to receive up to four fingers of the user's hand. Unlike the bore 15, the finger cup 16 is formed with a floor that prevents fingers within the finger cup from contacting the tray or the blades. Thus, items inserted into the bore can pass all the way to the tray and the blades, but items inserted into the finger cup cannot.

The guard is configured to be supported by a pair of sidewalls 33, 34 formed on opposite sides of the ramp. Most preferably, the sidewalls are raised above the generally planar surface of the ramp to provide a degree of clearance of the guard above the ramp. As described further below, the sidewalls serve as guides to ensure a linear path of travel of the guard along the ramp.

One side of the guard flange 12 includes one or more pads 17. The pads are formed from a material intended to improve the ability of the guard to slide along the sidewalls, reducing friction and enhancing durability. In the version as shown, two pads are provided, one toward the front and one toward the back end of a first side of the guard flange, each of the pads having a surface area that is much smaller than the surface area of the flange. Thus, the first side of the guard flange is configured to slide along the first sidewall 33 of the ramp.

The second side of the guard flange includes a pivotal coupling 21 secured to the guard by a hinge 20, as shown in FIG. 2. The coupling ensures that the guard remains in contact with the slicer and cannot become derailed during use.

The second sidewall 34 of the slicer ramp includes a slot 50 (see FIG. 3) that extends along the majority of the length of the second sidewall. The slot is formed along the lateral outside surface of the sidewall, and is formed with a lower surface that is generally horizontal, transitioning to a vertical wall within the slot. An upper portion of the slot is formed with an overhanging edge, such that the slot is configured as an L-shape when viewed from an end, perpendicular to the elongated side along which the slot extends.

Figure 3A:
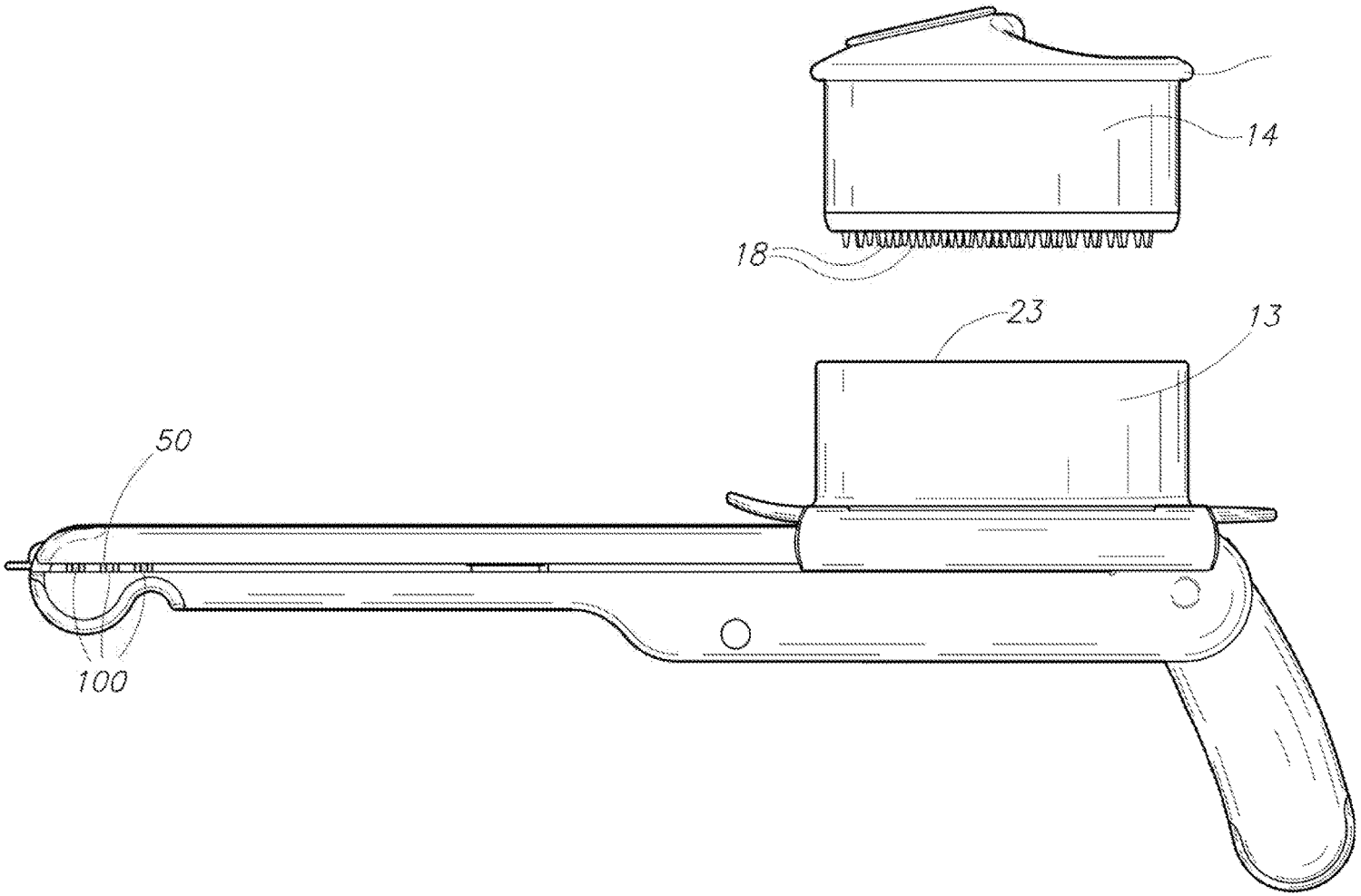
FIG. 3A is a side partial exploded view of a preferred mandoline slicer, shown with the hand guard partially exploded.
Figure 3B:
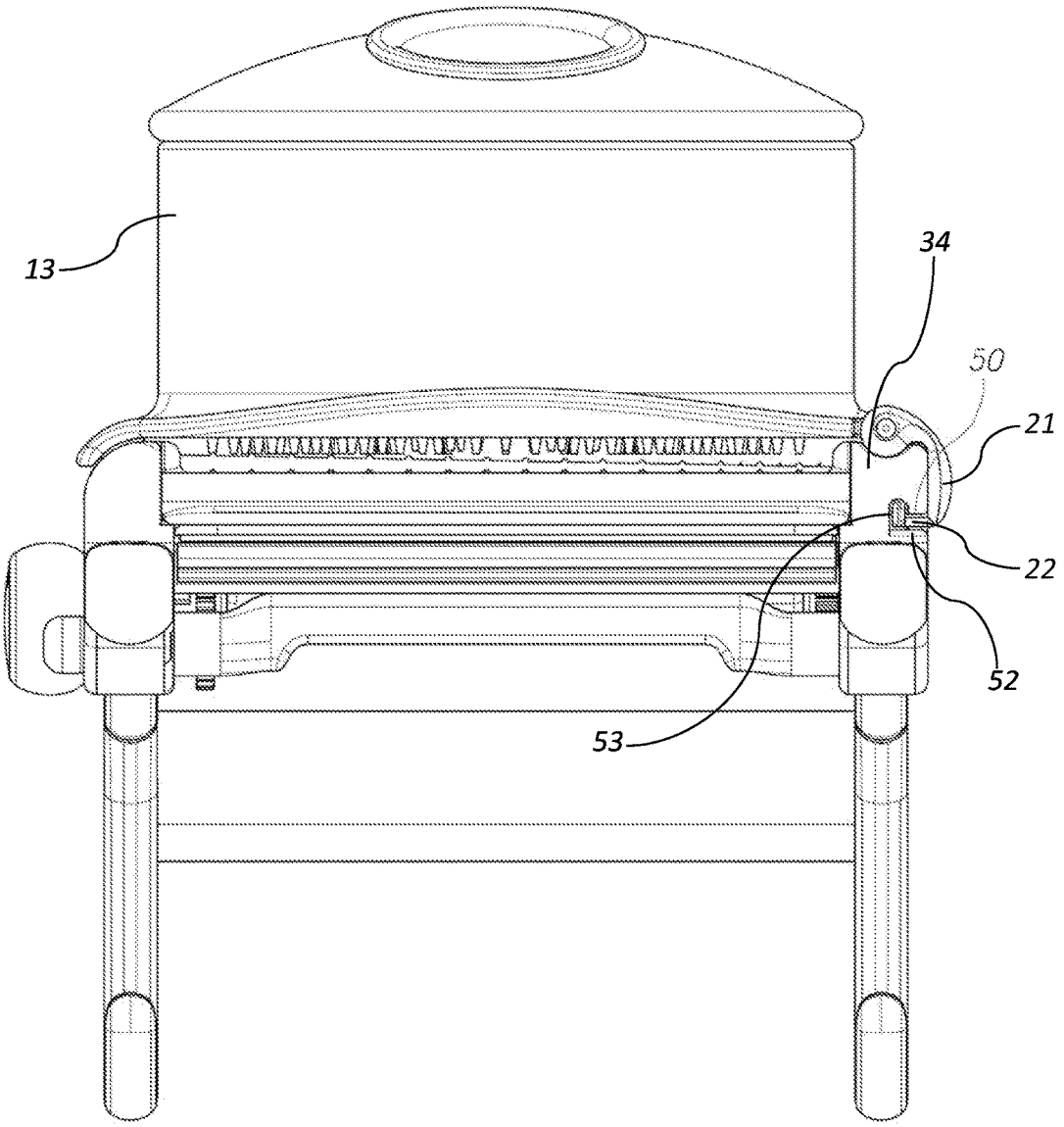
FIG. 3B is a front view of a preferred mandoline slicer.
Figure 7:
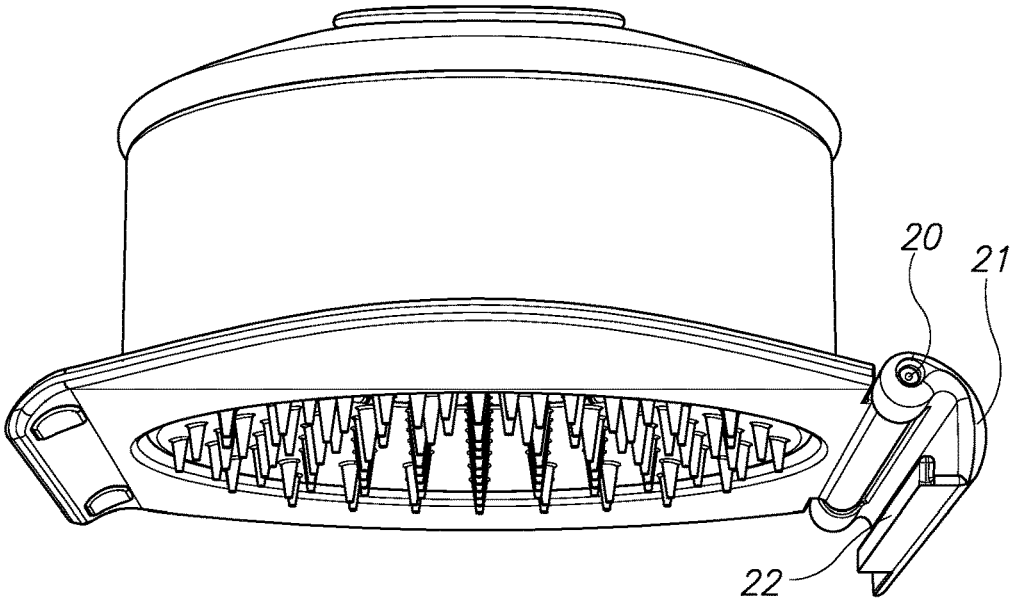
FIG. 7 is a bottom perspective view of the preferred hand guard for use with a mandoline slicer.

The coupling 21 is formed with a complementary finger configured 22 to be received within the L-shaped slot, as best seen in FIGS. 3B and 7. In the preferred version, the coupling includes a curved lateral face that extends from the pivotal connection along the upper portion of the guard wall downward to the slot. The lateral face transitions to a curved finger, in the version as shown having two substantially perpendicular bends such that the finger is trapped within the vertical portion of the L-shaped slot. Accordingly, the finger portion of the coupling cannot be inserted or removed from the slot in a lateral direction, but rather may only slide longitudinally along the slot. The coupling is inserted by positioning it at the open end of the slot at the end of the slicer, then sliding the coupling into the slot. Once in position, the grip and guard flange may be pivoted upward and away from the ramp 30 or pivoted downward such that it is parallel with the ramp.

Most preferably, when the guard is pivoted into an operable position parallel with the ramp (that is pivoted at the hinge 20 into the position as seen in FIG. 1), the lowest surface of the insert 14 and the gripping spikes 18 is raised somewhat above the surface of the ramp. This ensures that the grip and spikes are not cut by the slicer as it moves across the blade. The insert 14 is therefore formed with a peripheral flange 22 that abuts the upper rim 23 of the pillar in order to prevent the insert from falling fully through the pillar and contacting the ramp.

The second sidewall 34 further includes a channel 51 formed in the upper surface. The channel is sized and configured to receive the rounded shape of the hinge forming the pivot of the coupling, thereby allowing the hinge to slide smoothly down the sidewall.

In the preferred version, the ramp is adjustable to varying heights along the first portion of the ramp 31 leading to the blade 40. The first portion of the ramp comprises a substantially planar upper surface that is optionally formed with a plurality of ribs to reduce friction. The lower surface includes a pair of legs 90, 91 pivotally mounted to the lower surface and extending downward. The legs are positioned at opposite sides of the ramp, along the end of the ramp distant from the blade, and configured to abut the opposing sidewalls of the ramp. Each leg is pivotally secured to a respective one of the sidewalls to allow the first portion of the ramp to pivot about the pivot axis defined on the legs.

The upper end of the ramp 31 is pivotally movable about a pivot axis at the proximal end of the slicer, and in the preferred version the pivot axis is a common pivot axis also shared by the legs 90, 91 to allow the legs to pivotally rotate to a stored and deployed position. Thus, the legs 90, 91 and the first portion of the ramp 31 are both mounted along a common pivot axis at opposing pivot points 61, 62. A spring 63 is carried on the pivot axis of one of the legs 91 in order to bias the ramp in a downward position. Thus, in the preferred version the spring is a coil spring having one end attached to the lower side of the ramp and the opposite end attached to the sidewall adjacent the leg in order to urge the ramp downward and bias the portion of the ramp adjacent the blade into a downward position beneath the blade.

Figure 4:
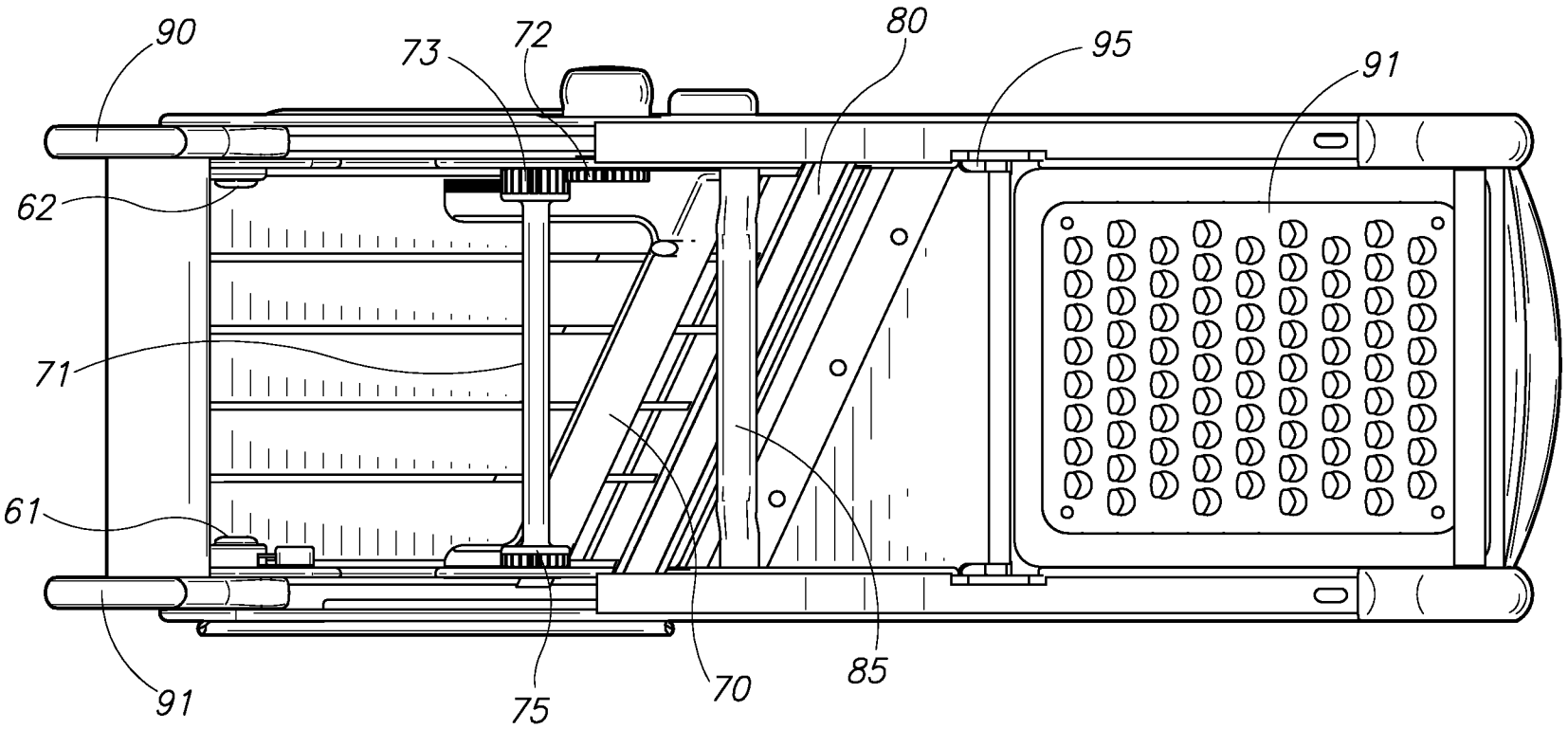
FIG. 4 is a bottom plan view of a preferred mandoline slicer.
Figure 5:
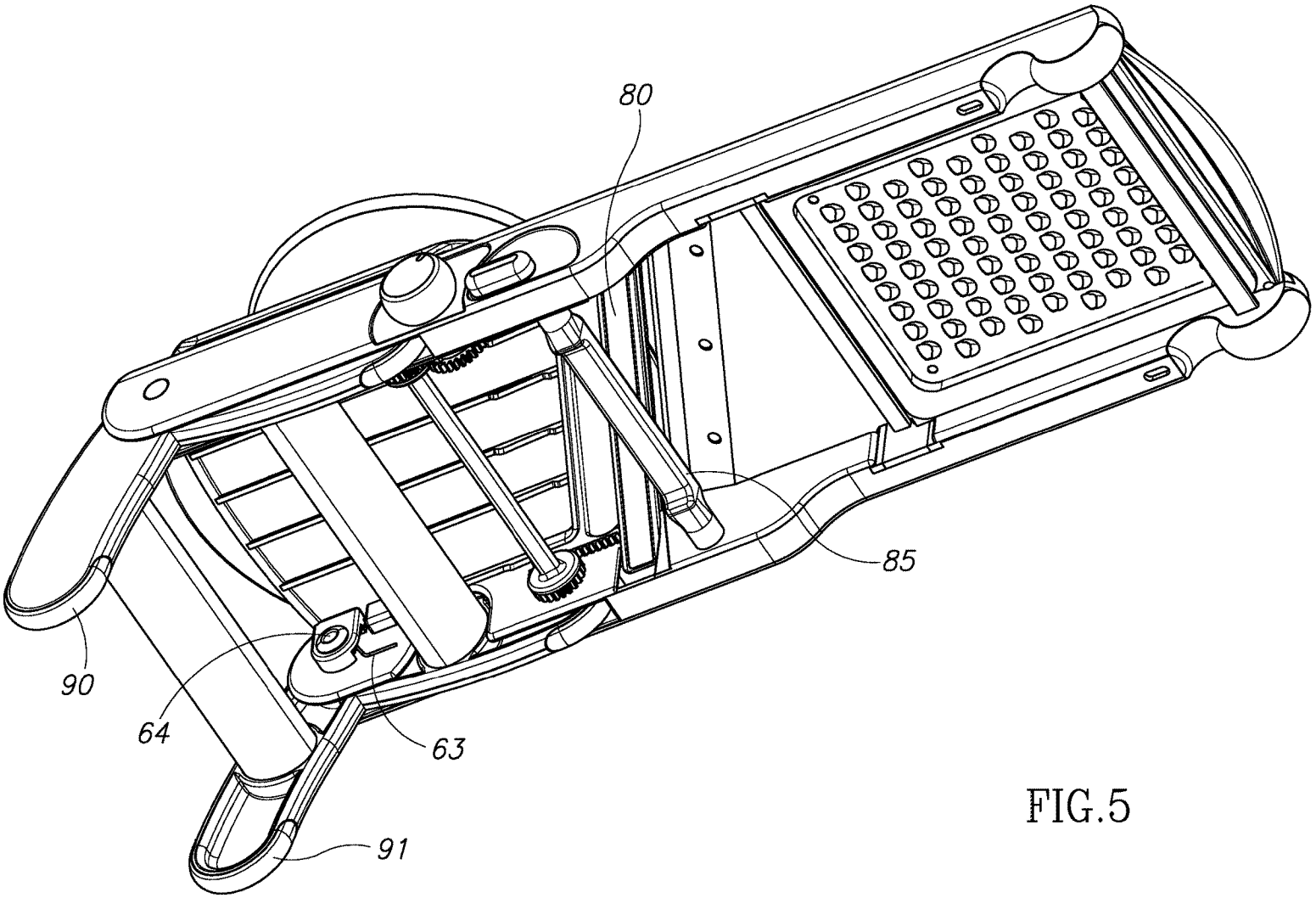
FIG. 5 is a bottom perspective view of a preferred mandoline slicer.
Figure 6:
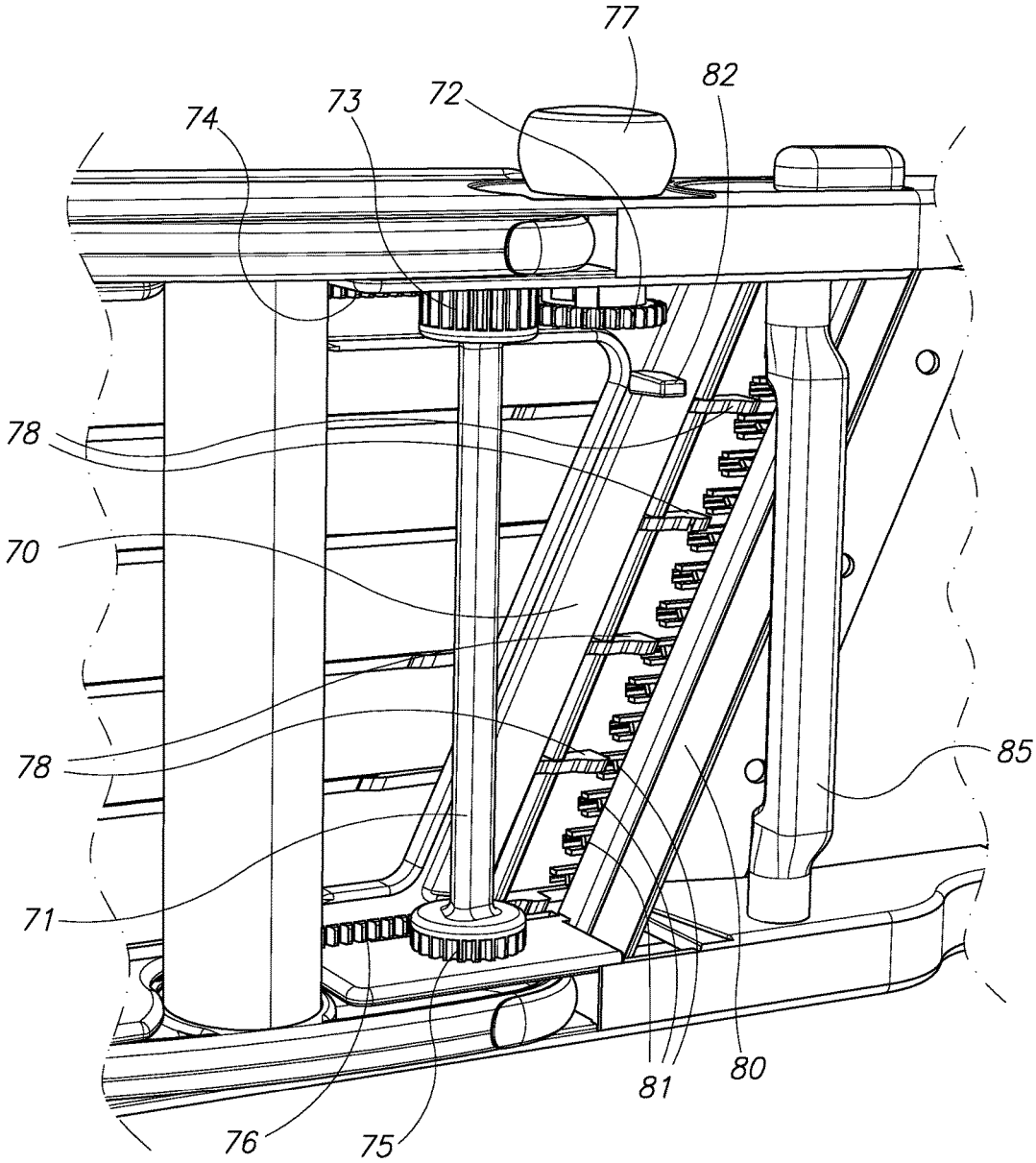
FIG. 6 is a partial close-up bottom view of a preferred mandoline slicer.

The first portion of the ramp 31 is adjustable in order to adjust the depth of the cutting blade with respect to the first end of the ramp adjacent the blade. Thus, the first portion of the ramp is selectively rotatable about the pivot point 64, thereby selectively altering the positioning of the edge of the first portion of the ramp with respect to the blade 40. The adjustment mechanism is best seen in FIGS. 4-6 showing the lower side of the ramp. A knob 77 is positioned on an outer surface of the sidewall and is carried on an axle for rotational movement. The axle extends through the sidewall to the inner surface of the sidewall where the axle secures to a first gear 72. The teeth of the first gear mesh with the teeth of a second gear 73 that is also pivotally supported by the sidewall. The second gear is further secured to an axle 71 that extends across the width of the ramp to the opposite sidewall. At the opposite end of the sidewall a third gear 75 is carried on the axle and pinned to the sidewall. Accordingly, rotation of the knob causes rotation of the first gear 72 and, by meshing of the teeth, rotation of the second and third gears 73, 75.

A ramp support 70 is slideably attached to the inner surfaces of the opposing sidewalls so that it may slide back and forth, generally along the plane formed by the first portion of the ramp. The support is generally in the shape of a skewed U, in which the base portion is angled and the two uprights are of unequal lengths. Each of the uprights includes a series of teeth 74, 76 that mesh with the teeth of a respective gear 73, 75. Consequently, rotation of the second and third gears (which are fixed in position to the sidewalls) causes lateral movement of the support structure by movement of the teeth 74, 76.

The base portion of the support structure (that is, between the two uprights) extends laterally across the width of the lower side of the first portion of the ramp. The lower side of the first portion of the ramp is formed with a series of stepped ribs 78 that are increasing in height as they move away from the pivot end of the ramp. Movement of the support 70 in a first direction (that is, in the direction toward the blade) causes the support structure to engage taller steps of the ribs, thereby pushing the ramp upward (with "upward" being a direction from the bottom side of the ramp toward the top side of the ramp). In the highest position, the ramp is preferably flush with or slightly above the sharpened edge of the blade so that no slicing may occur. Movement of the support in a second opposite direction (that is, away from the blade 40 and toward the legs) causes the support structure to engage shorter steps of the ribs 78, and the spring 63 urges the ramp downward, inclining it below the sharpened blade. By selectively rotating the knob 77 to cause the support to engage a desired level along the stepped ribs, a desired differential can be achieved between the vertical height of the ramp with respect to the position of the fixed blade. Accordingly, the thickness of the slices produced can be adjusted by turning the knob. As seen in FIG. 1, the sidewall may include thickness indicators adjacent the knob 77 to indicate to the user the relative slicing thickness at particular knob rotational locations.

Figure 8:
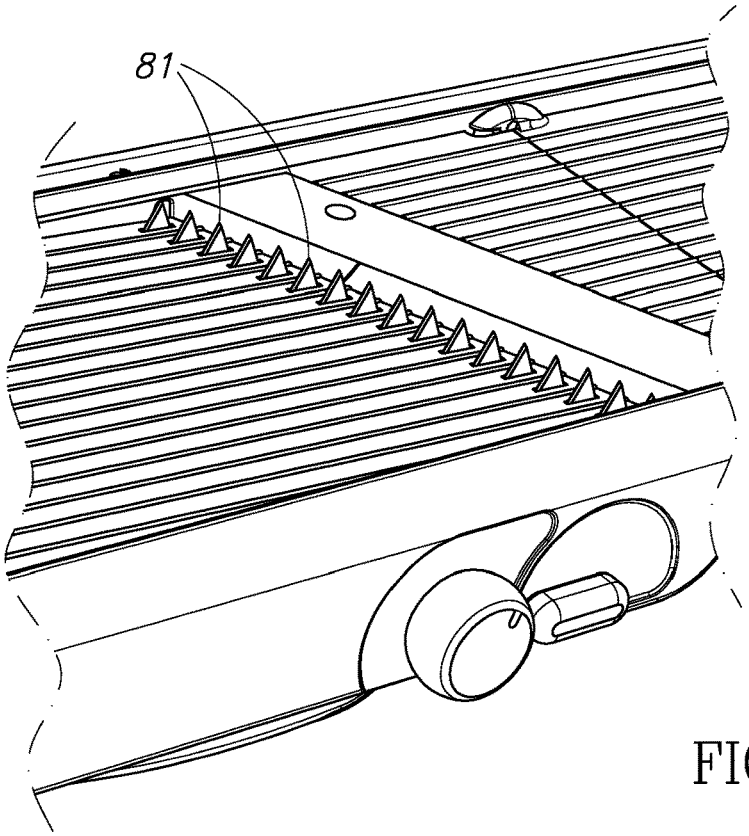
FIG. 8 is a partial close-up top perspective view of a preferred mandoline slicer.

A series of julienne blades may also be provided. As best seen in the close-up view of FIG. 8 and the bottom views of FIGS. 5 and 6, several blades 81 are carried by a bar 80 positioned beneath the lower surface of the slicer. A corresponding series of slots 39 is formed in the first portion of the ramp at a location adjacent the blade, such that each one of the vertical julienne blades is extendable upward and through the slots or retractable beneath the slots. The bar (and therefore the julienne blades) is preferably oriented to be parallel with the line defining the sharpened edge of the blade 40.

The vertical movement of the julienne blades 81 is effected via a lever pivotally mounted on an outer portion of one of the sidewalls. In the illustrated version, the lever is mounted adjacent the slicing adjustment knob. The lever 83 is carried on an axle extending through the sidewall and extending across the lower side of the ramp where it is pivotally mounted to the opposite sidewall. The julienne axle 85 includes a cam surface (best seen in FIG. 5) whereby rotation of the lever to a first position causes the cam surface to push the julienne bar upward and rotation of the lever to a second position moves the cam surface away from the julienne bar, allowing it to move downward. In the preferred version, the cam surface extends substantially along the entire length of the axle, in which one side of the axle is radially offset with respect to the opposite side of the axle. Both opposing sides of the axle have substantially flat surfaces so that they may engage the corresponding flat lower surface of the julienne bar 80. The engagement of the mutually flat surfaces prevents the julienne axle 85 from freely rotating unless a user turns the lever to cause it to rotate.

The slicing adjustment knob further includes a feature for ensuring that the julienne blades are retracted when the ramp is adjusted to a locked position. When the support 70 is moved to its farthest position, engaging the tallest steps on the ribs 78, the ramp is pushed upward to a height at least somewhat above that of the blade 40. Accordingly, the ramp is in a substantially safe position in which there is little or no risk if contact with the blade. Because the julienne blades are vertical and have a height that is above the height of the slicing blade 40 when they are deployed, the support 70 further includes a vertical stem 82 (see FIG. 6) extending downward from the support at the base of the U shape, in a direction away from the ramp. As the support slides toward the farthest step on the ribs, the stem encounters an edge of the julienne axle 85, causing it to rotate. If the julienne bar is already in the stowed position, the stem slides beneath the julienne bar without contacting it. Because of the offset axial alignment of the julienne axle, the rotation caused by the stem 81 will cause the julienne blades to retract to the stowed position beneath the surface of the ramp. Thus, rotation of the adjustment knob to the locked or stored position also causes the julienne blades to retract to a stored position if it is not already in that position. Appropriate indicators on the sidewall of the device provide a visual indication of the locked and deployed positions, as well as positions corresponding to the various steps in the ribs.

At the distal end the lower surface of the slicer includes feet having a nonskid or elastomeric material applied. At the proximal end, the slicer includes pivotally retractable legs 90, 91. When extended, the legs raise the rear end of the slicer with respect to the front end of the slicer, thereby forming a downward incline from the rear toward the front end of the slicer.

Figure 9:
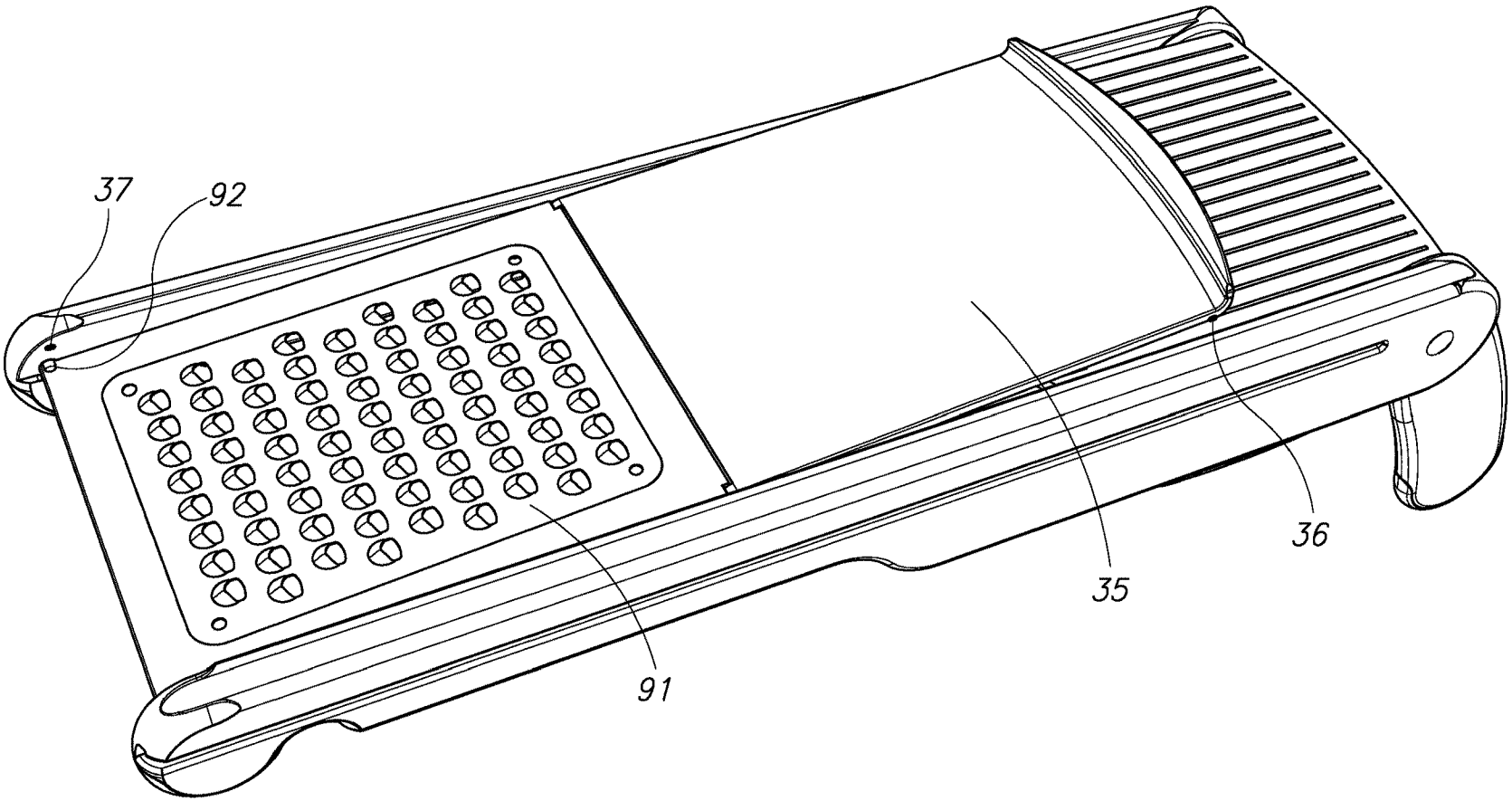
FIG. 9 is a top perspective view of a preferred mandolin slicer, shown without the hand guard and with a portion of the slicing ramp pivoted to expose a grating surface.
Figure 10:
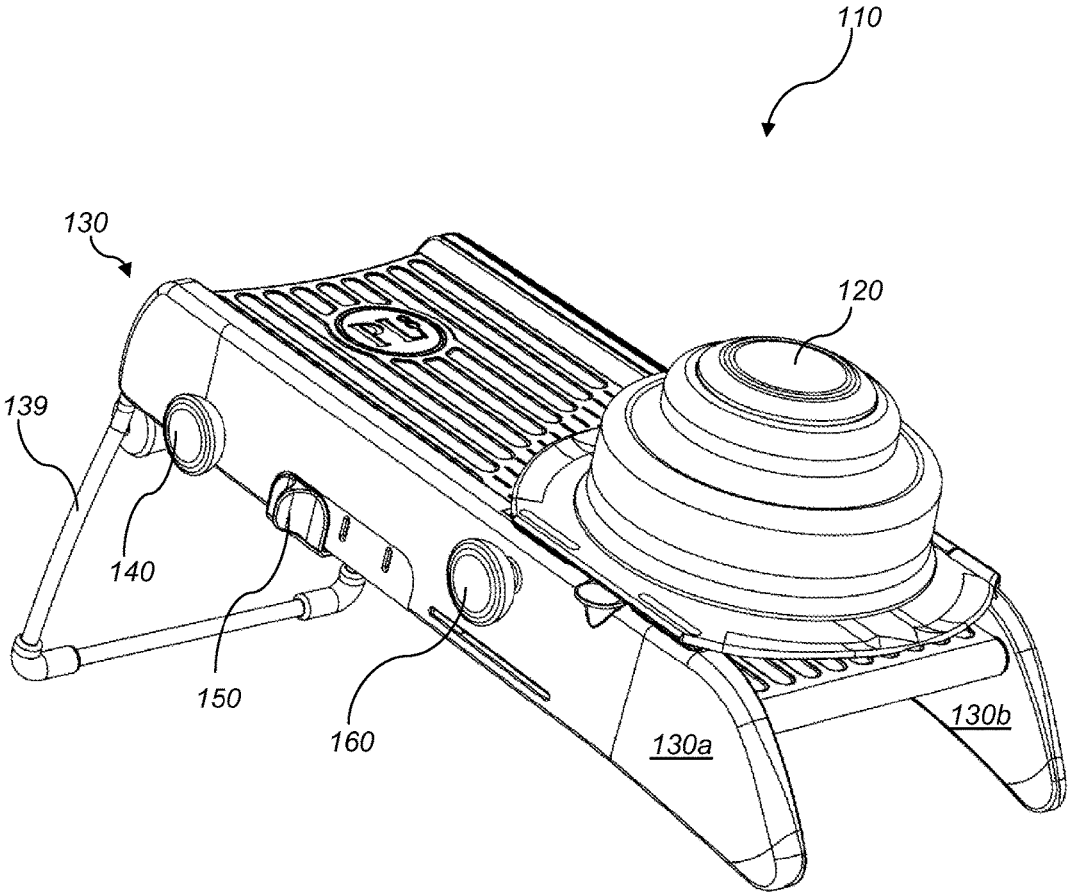
FIG. 10 is a top perspective view of an alternate preferred mandolin slicer, shown with a hand guard attached.
Figure 11:
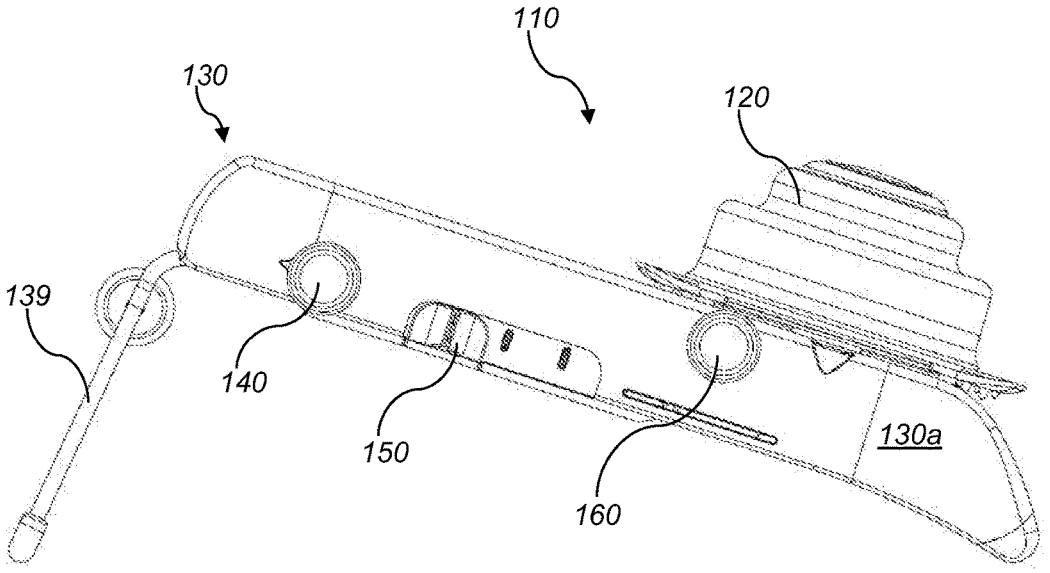
FIG. 11 is a side view of the alternate preferred mandolin slicer.

The forward or distal portion of the ramp 32 may be integrally formed with the ramp in some versions of the invention. In other versions of the invention, it is pivotally attached to facilitate use of a grating surface positioned beneath it. In such a version, the forward ramp surface 32 has a first end 35 adjacent the slicing blade and a distal second end. The first end is pivotally mounted so that the ramp may be rotated about the pivot point approximately 180 degrees. In the pivoted orientation, it covers the slicing blade and exposes a grating surface that otherwise lies beneath the forward portion of the ramp in its standard position. In FIG. 9, the first end 35 of the ramp is pivoted to expose the grating surface 91, while in the remaining figures it is pivoted to cover the grating surface.

A grating surface 91 is supported at the forward end of the slicer. In the preferred version, the grating surface is planar in shape and spans the width of the sidewalls. The grating surface is pivotally mounted to the forward end of each of the opposing sidewalls, for example at a location 92, so that it can pivot somewhat between a substantially horizontal stowed position and a slightly inclined operational position.

Adjacent the pivot axis of the forward ramp 32, each side includes an arm 95 extending rearward from the pivot point. As the forward ramp is pivoted upward and about the pivot axis carrying the arms 95, the arms rotate below the plane of the ramp and an end of the arms engage a lower surface of an end of the frame of the grating surface. As the forward ramp continues its pivotal movement to a point where it covers the slicing blade (that is, having been rotated approximately 180 degrees), the arm continues to pry the end of the grating surface upward. The face of the arm in contact with the grating surface is configured to support the end of the grating surface at a desired angle. In the preferred version, the grating surface is slightly inclined with respect to the plane defined by the overall ramp. Accordingly, the rotation of the forward portion of the ramp 32 causes the arms to slightly raise the adjacent end of the grating surface 91 such that the rotated forward end of the ramp 32 and the grating surface lie substantially in the same plane.

The forward portion of the ramp further includes one or more tabs 36 that are positioned to engage corresponding slots formed along the sidewalls, such that when the forward portion of the ramp is fully pivoted away from the grating surface the tabs engage the slots to hold the forward portion of the ramp in a position generally adjacent the slicing blade. In this position, the forward portion of the ramp is at or below the level of the upper surface of the sidewalls so that the guard may slide over the top of the forward portion of the ramp and along the grating surface. An additional pair of slots 37 is formed at the forward end of the sidewalls to engage the tabs when the forward ramp is in its stowed position, covering the grating surface.

As best seen in FIG. 3A, an inner surface formed in the L-shaped slot 50 further includes a stop configured to slow or limit travel of the hand guard coupling within the slot. In the preferred example, the stop is configured as section of resilient material, and as illustrated it forms a series of ribs 100 housing TPE or other resilient material. The TPE provides further frictional resistance, additionally helping retain the coupling within the slot while still allowing it to be removed if desired. In the illustrated version, three resilient ribs are shown. A greater or smaller number of ribs may be provided in alternate versions.

An alternate version of a preferred mandolin slicer is illustrated in FIGS. 10-29. The alternate slicer incorporates some of the features described above, together with some additional alternate features.

In accordance with some of the preferred aspects of an alternate slicer (which may include one or more of the particular preferred features), the mandolin slicer 110 includes a frame 130 configured with side walls 130*a*, 130*b* having upwardly extending rails to accept a hand guard or pusher 120 and having a support leg 139. In the illustrated version, the leg is pivotally attached at a rear end of the frame, and includes one or more rear feet formed from a material to provide a non-skid surface. In some versions, a handle may be mounted between opposing left and right rear legs at a location between the feet and the location of pivotal attachment to the frame.

Figure 12:
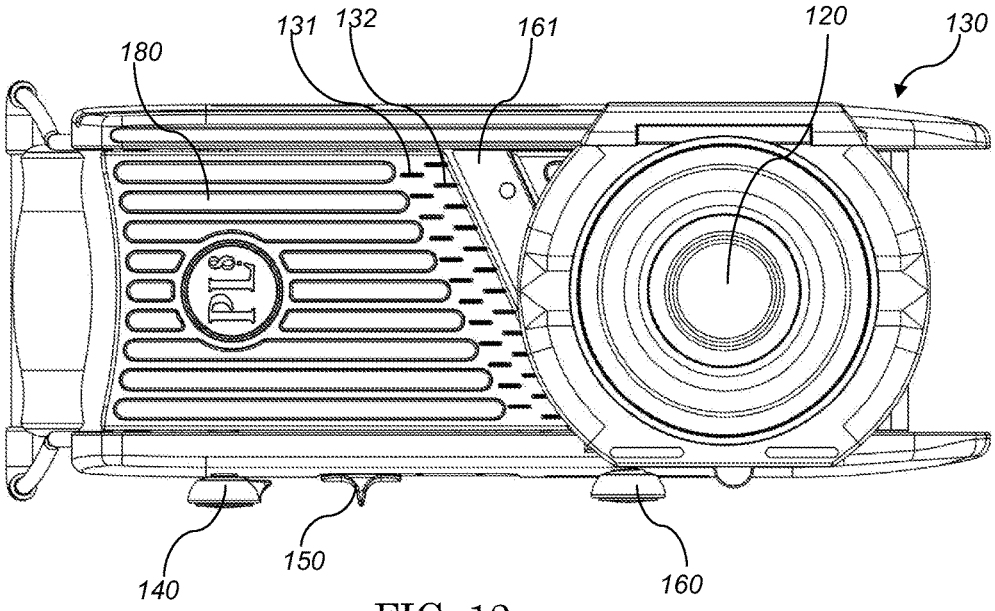
FIG. 12 is a top view of the alternate preferred mandolin slicer, shown with a hand guard attached.
Figure 13:
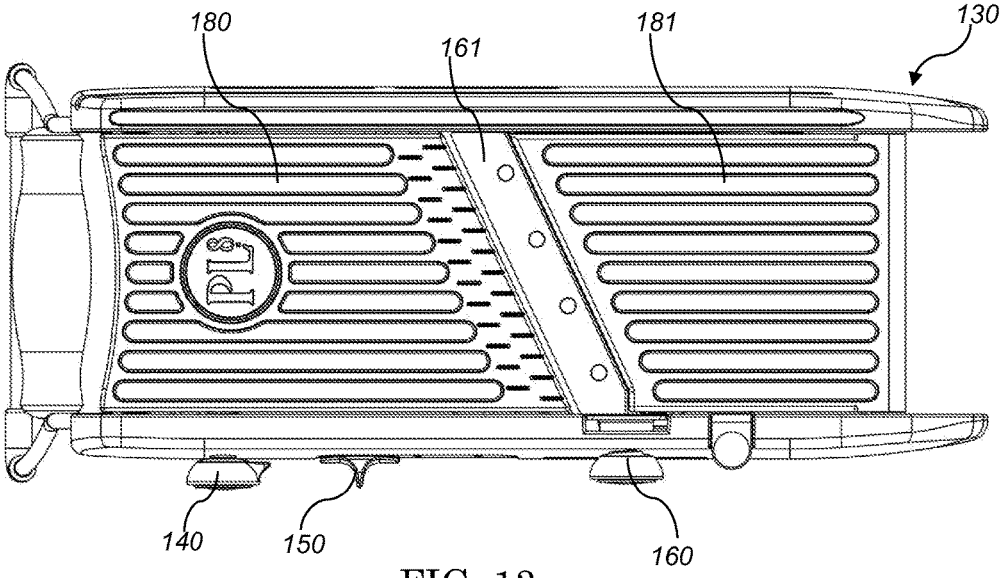
FIG. 13 is a top view of the alternate preferred mandolin slicer, shown without a hand guard attached.
Figure 14:
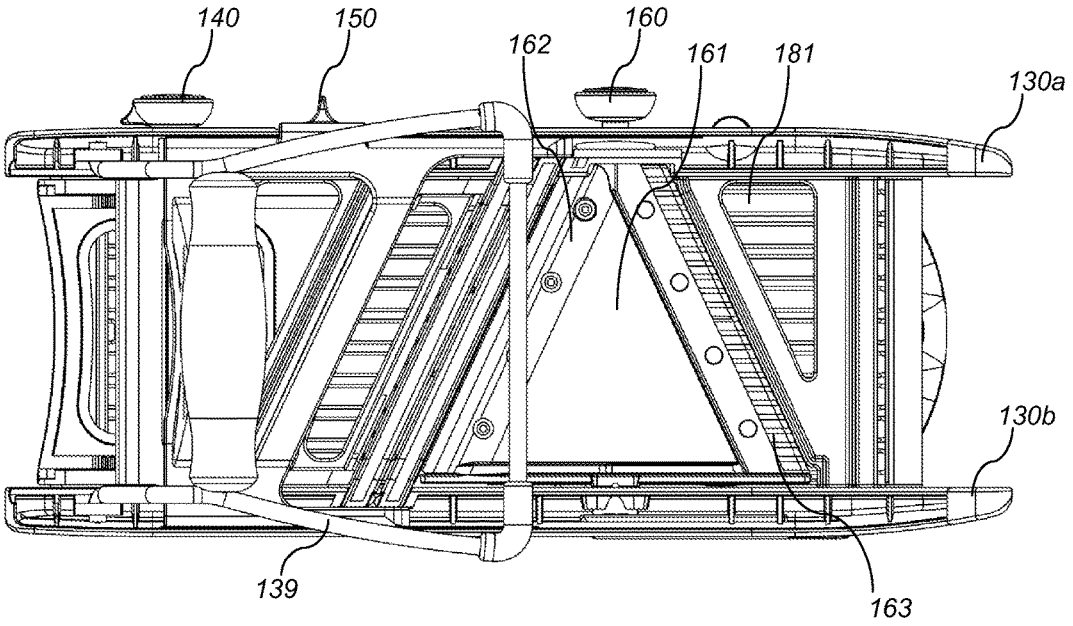
FIG. 14 is a bottom view of the alternate preferred mandolin slicer.

As best seen, for example, in the top plan views of FIGS. 12 and 13, the mandolin slicer further includes a platen 180 having a proximal end (adjacent the rear of the slicer) and a distal end (at the forward end of the slicer, where the item being sliced will complete its path of travel). The platen in the preferred version includes two rows of holes 131, 132 at the distal end to receive retractable vertical blades (sometimes referred to as "julienne blades"). A main blade 162 extends between opposing frame side rails, preferably at an angle that is not perpendicular to the side rails. The sharpened edge of the main blade is separated from the distal end of the platen by a small gap that allows the platen to be raised to a height which is preferably slightly above the blade, and lowered to a position beneath the blade in order to adjust the slicing thickness.

A runout plate 181 (see FIG. 13) is positioned at the forward end of the slicer, configured such that when the platen is in the raised position the platen and runout plate lie substantially in the same plane. Most preferably, in the stored position the platen is raised at least slightly above the main blade and the runout plate.

A platen adjuster knob 140 extends laterally outside the frame and is configured for rotation to raise and lower the platen as described further below. A julienne/fry selector slide 150 also extends laterally outside the frame and is connected to an internal selector frame to raise and lower a pair of rows of julienne blades. A blade knob 160 also extends laterally from the frame, and is configured to selectively rotate a pair of blades into or out of position for slicing.

The platen 180 is substantially planar over most of its area, with a plurality of longitudinal ribs and grooves extending from the rearward end to the forward end to reduce friction as food items travel toward the main blade. A first row of holes 131 and a second row of holes 132 are each positioned at the forward end of the platen, positioned adjacent the main blade when the slicer is assembled. In a preferred version of the invention, the platen is formed from stainless steel, though in other versions different materials may be suitable.

A platen support 182 (see, for example, the exploded view of FIG. 16) is mounted below the platen to hold the platen in its selected vertical position with respect to the frame. The platen support includes a pair of opposing left and right legs at the rearward end, each having outwardly extending rear tabs 183*a*, 183*b*, and a pair of opposing left and right legs at the forward end, each having outwardly extending forward tabs 184*a*, 184*b*. The forward end of the platen support further includes a row of slots 185 positioned to receive julienne blades and positioned to align with the first row of holes 131 formed in the platen.

The outwardly extending tabs in the platen support are received in vertically-extending grooves (e.g. 133, 134) formed in the rear end of the frame sidewalls. A pair of grooves is formed on each of the left and right sidewalls of the frame at the rearward end, to receive the four outwardly extending tabs; within FIG. 16 the grooves (133, 134) on one of the sidewalls is visible while the opposing grooves are hidden from view. The grooves and tabs are sized and configured to allow the tabs to travel up and down within the grooves, thereby allowing the platen support to travel upward and downward.

A height adjuster 186 extends laterally between the opposing left and right frame sidewalls to cause the platen support (and therefore the platen) to raise and lower. The height adjuster includes a pair of laterally extending fins 189*a*, 189*b* that are received in axially extending channels (e.g., 36; an opposing channel in the opposing sidewall is not visible) formed in the frame sidewalls. Thus, each sidewall includes a channel 36 extending in a direction from the rear toward the front of the slicer, and positioned beneath the area defined by the platen. The channels 136 are longer than the fins 189*a*, 189*b*, thereby allowing for some linear travel, forward and backward, of the height adjuster within the channels.

The height adjuster further includes a pair of left and right pegs 187*a*, 187*b*, 188*a*, 188*b* positioned on the left and right sides of the height adjuster and extending laterally outward toward the opposing left and right frames. The left and right pegs of the height adjuster are trained in inward-facing inclined channels 190*a*, 191*a*, 192*a*, 193*a* formed on lateral downwardly-depending skirts 190, 191, 192, 193 of the platen support (see FIGS. 18, 19). The channels are inclined upwardly from the rear end toward the front end, such that movement of the height adjuster in the forward direction with respect to the platen support causes the pegs to travel upward in the channels, pulling the platen support downward toward the height adjuster. Movement in the opposite direction pushes the platen support upward, away from the height adjuster.

A lower surface of the height adjuster is formed with a series of linear gear teeth 147, 148 positioned on each of the left and right sides of the height adjuster. A guide gear includes a main axle 141 extending between opposing sidewalls of the frame, with a pair of gears 142, 143 positioned at each end of the main axle. The gears 142, 143 are meshed with the linear gear teeth on opposing racks 147, 148, such that rotation of the axle causes movement of the gears within the linear gear teeth.

The distal end of the main axle terminates in a set of axially directed teeth 149 which mesh with a mating gear 136 mounted to the sidewall. The mating gear 136 (see FIGS. 16, 17) is fixed in position against the sidewall, such that when the main axle teeth 149 are enmeshed with the mating gear 136, the main axle will not rotate. The main axle is supported within a channel 201 formed in a lateral frame support 200 extending between opposing frame sidewalls.

Figure 16:
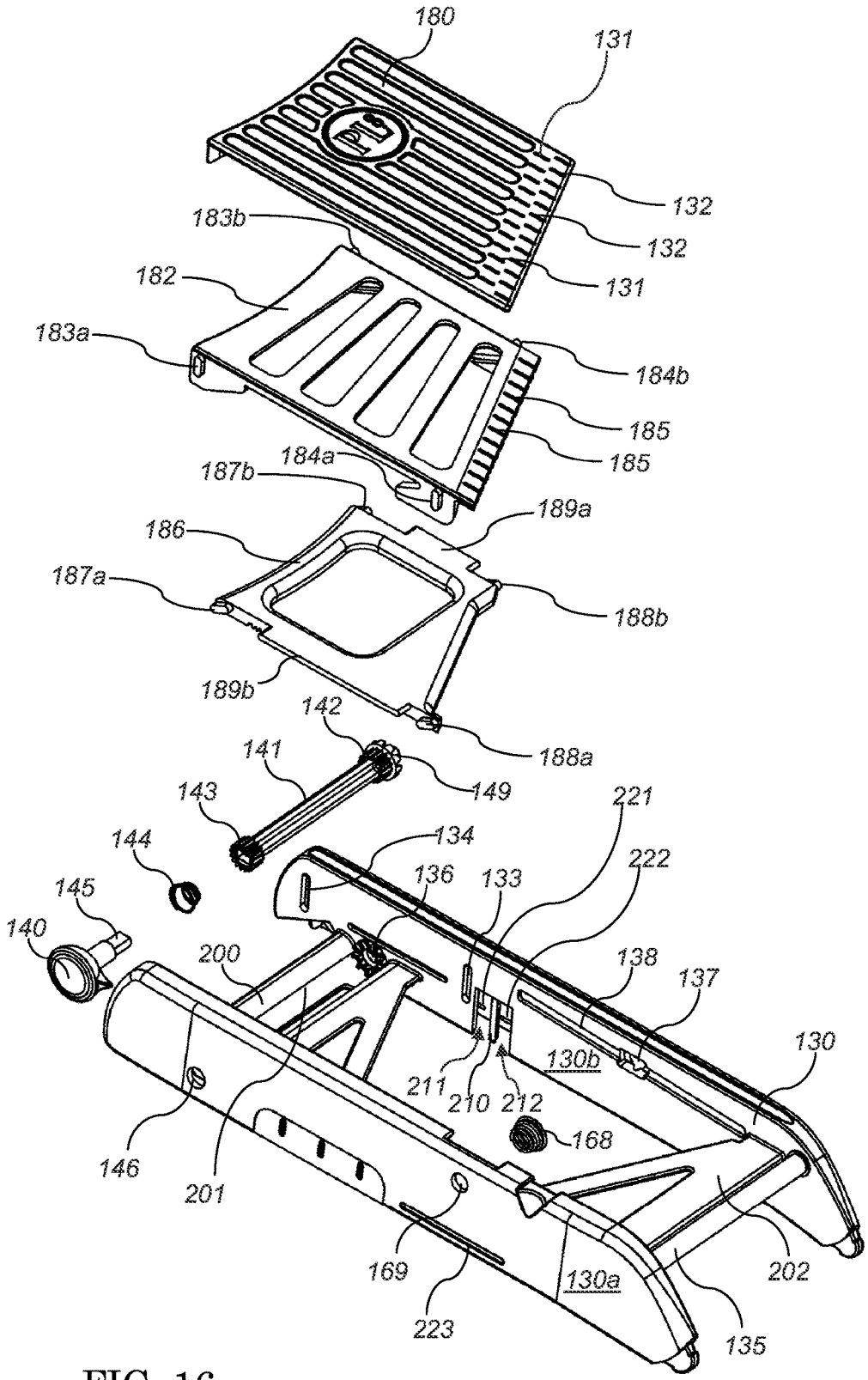
FIG. 16 is a partial exploded view of the alternate preferred mandolin slicer, including a platen and platen support.
Figure 17:
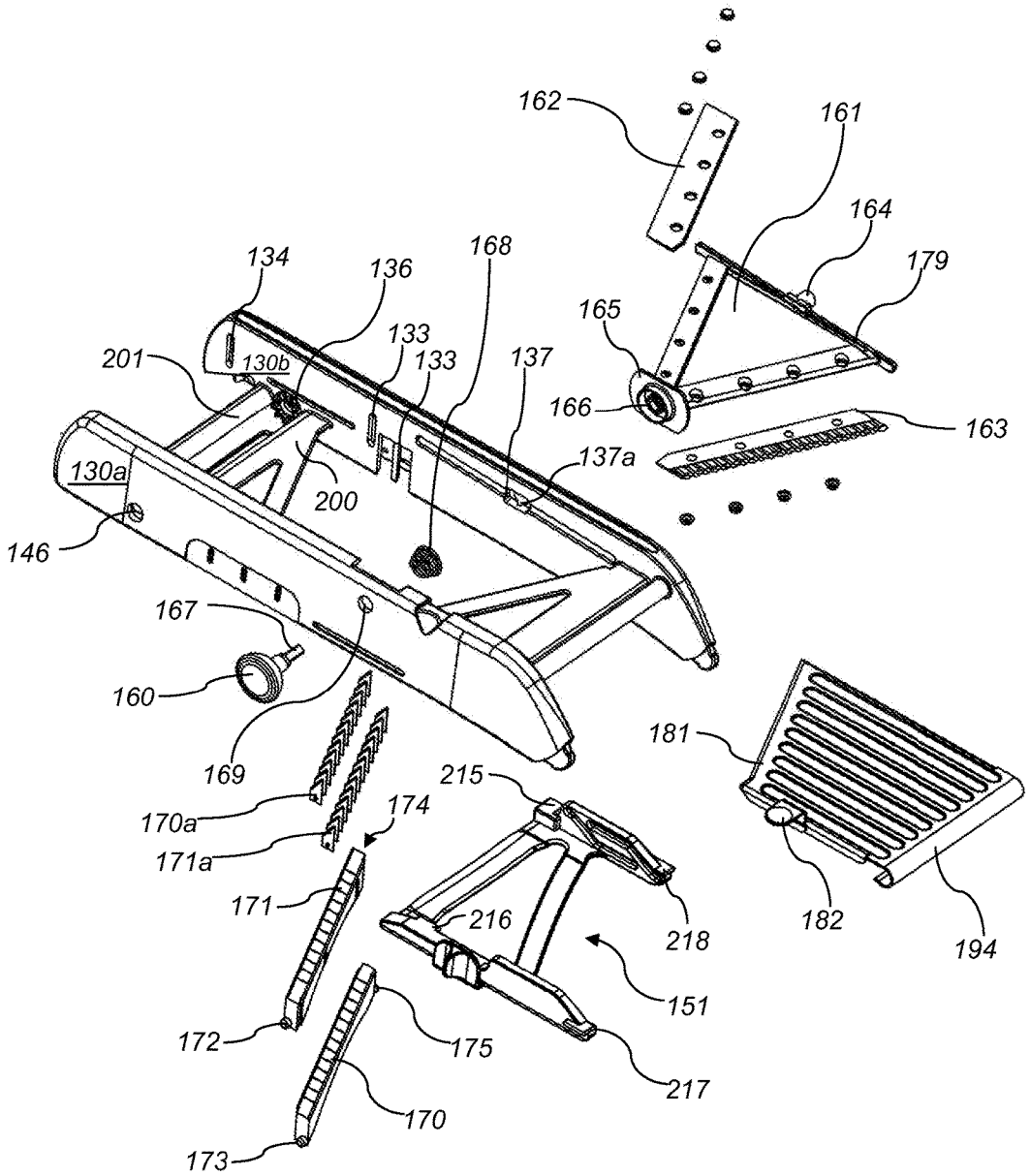
FIG. 17 is a partial exploded view of the alternate preferred mandolin slicer, including a runout plate and selectable slicing blade.
Figure 18:
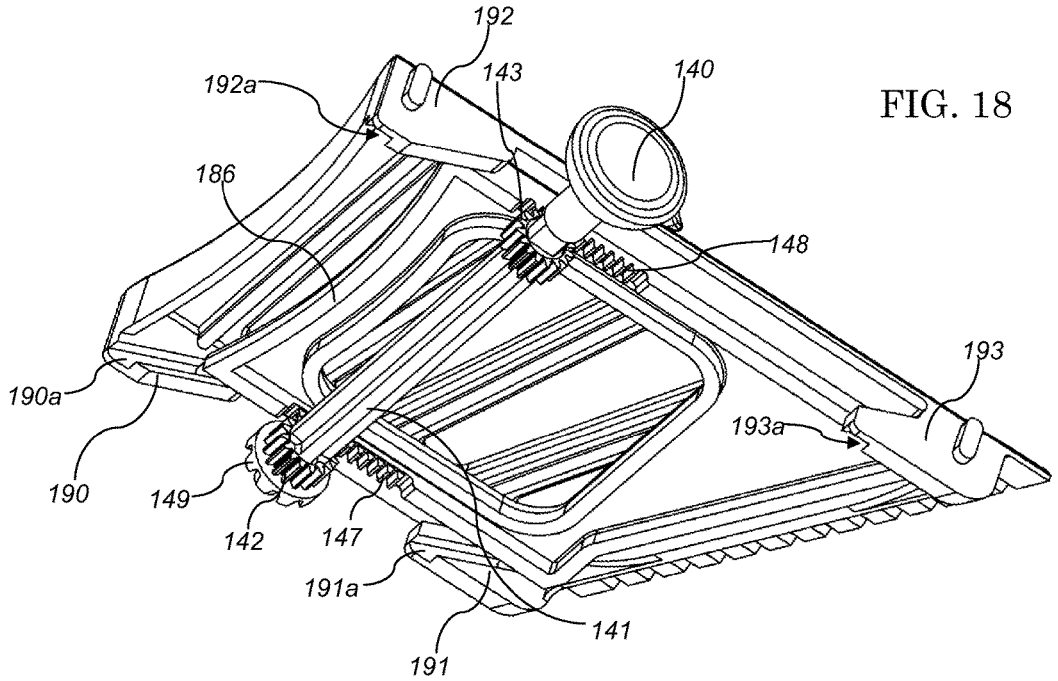
FIG. 18 is a bottom view of an adjustable platen support shown in a first position.
Figure 19:
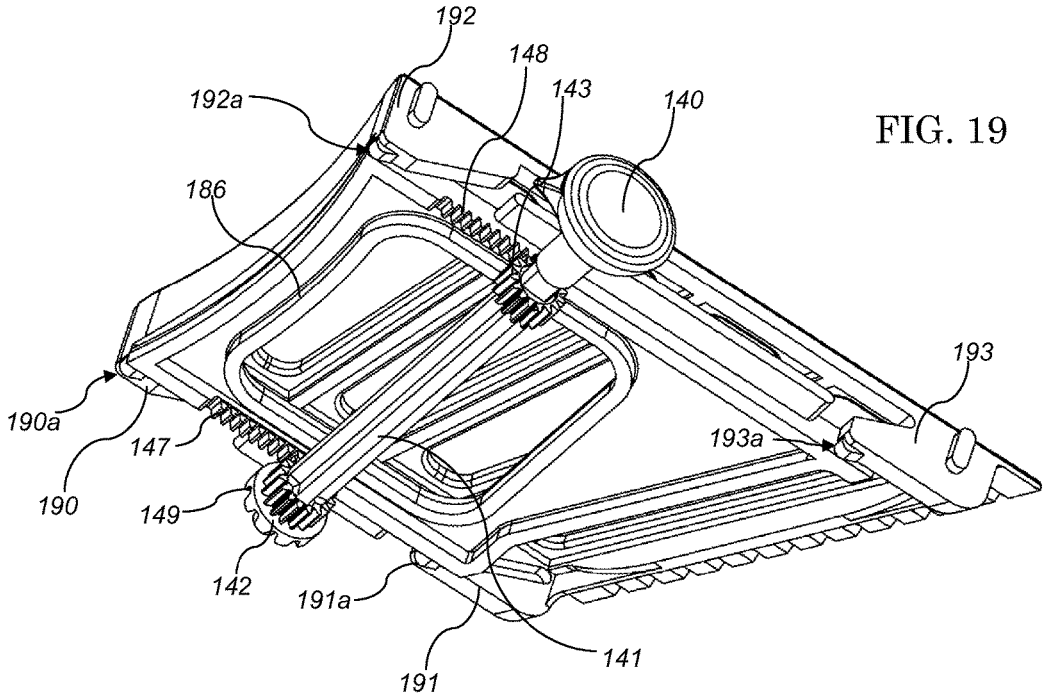
FIG. 19 is a bottom view of an adjustable platen support shown in a second position.

A proximal end of the main axle 141 includes a cavity to receive a stem 145 of an adjuster knob 140 (see exploded view of FIG. 16). The adjuster knob stem extends through the hole 146 formed in the frame sidewall such that rotation of the adjuster knob causes rotation of the main axle. A spring 144, preferably configured as a coil spring, is carried on the stem 145 of the knob and positioned between the right gear 142 and the adjacent frame sidewall. The spring urges the main axle inward, toward the left sidewall 130*b*, in which the axial gear 149 is enmeshed with the mating gear 136 in order to prevent rotation of the axle and thereby to maintain the platen in position. When a user desires to raise or lower the platen, the knob 140 is pulled outward from the right sidewall 130*a*, thereby separating the axial gear teeth 149 from the mating gear 136 positioned on the left sidewall 130*b* and allowing rotational movement of the axle. The rotation of the knob and axle causes the gears 142, 143 to move the adjuster, which in turn causes the platen support to move upward or downward.

The platen terminates adjacent a cutting blade supported by a main blade frame 161. The main blade frame is generally triangular in shape, having a main blade 162 mounted at one side and a second blade 163 mounted at a second side. In the illustrated version, the second blade is a waffle blade. Other blades having serrations or scalloped edges may also be used. The third side of the triangular main blade frame 161 is positioned along an inside wall of the left sidewall 130*b*.

The thickness of the main blade 162 and second blade 163 form a slight step or height above the main blade frame 161. In a preferred version of the invention, the runout plate 181 is configured in a thickness such that it lies at about the same height or slightly below that of the main blade or second blade when either blade is in position and the runout plate is rotated down atop the main blade frame. Accordingly, an object being sliced can travel down the platen, encounter the blade, and continue smoothly down the runout plate without being snagged by the runout plate.

The main blade frame includes a mounting plate 165 positioned at an apex where the first and second blades meet. The mounting plate terminates in a cylindrical hub 166 having an internal central slot for receiving a stem 167 from the blade knob 160, which extends through a hole formed in the right frame sidewall 130*a*.

The third side of the main blade frame terminates in an elongated fin 179 having a central mounting stem 164. The mounting stem 164 is received in a recess 137 formed in the interior of the left sidewall 130*b*. In one version, the recess further includes a short projection 137*a* that is sized to fit within a complementary cavity formed in the mounting stem. An elongated channel 138 is also formed in the left sidewall, with the recess 137 being positioned substantially at the middle of the channel. When the main blade frame is in position within the frame, the elongated fin 179 is received within the channel 138 and the stem 164 is received within the recess 137.

The blade knob 160 includes a stem 167 that extends through a hole 169 formed in a right side of the frame. A coil spring 168 is trained around the stem and trapped between the mounting plate 165 and the frame sidewall 130*a*. The spring is configured to urge the main blade frame in a direction from the right sidewall 130*a* toward the left sidewall 130*b*, and therefore pushes the fin 179 into the elongated channel 138. Accordingly, the elongated fin and channel configuration prevent rotation of the main blade frame 161.

In order to rotate the main blade frame, a user pulls the blade knob outward and away from the right sidewall of the frame 130*a*. The spring compresses as the fin 179 is removed from the channel 138. The stem 164, however, is sized such that it remains within the recess 137, with the projection of the recess also remaining within the cavity formed in the stem. Thus, the main blade frame can now rotate within the recess because of the separation of the fin from the channel. By rotating the knob, the main blade frame can be rotated into a position in which either the first or second blade is positioned toward the platen, as desired.

The runout plate 181 covers the majority of the main blade frame other than either the first or second blade, whichever is positioned adjacent the platen. The runout plate 181 includes a forward end 194 having a terminal U-shape, which can be snap-fit around a beam or axle 135 extending between the left and right frame sidewalls 130*a*, 130*b*. The attachment of the runout plate 181 to the axle allows the runout plate to pivot about the axle.

A lateral tab 182 is formed on the runout plate, preferably integrally formed with the runout plate. When the runout plate is in the working position (as in FIGS. 11-15), the tab is seated within a shallow well 129 formed in the upper right sidewall 130*a*. In order to rotate the blade frame, the user grasps the tab 182 to rotate the runout plate 181 upward to a raised position (as in FIGS. 23-25), thereby allowing access to the main blade frame 161 for rotation. Once the blade frame is rotated, the runout plate is dropped down in position again for use. The shallow well 129 is sized and configured to form a friction fit with the tab 182 in order to hold the runout plate snugly downward against the blade frame for use. In other versions, the well and tab may include magnets or other features to lock the runout plate in place.

Figure 23:
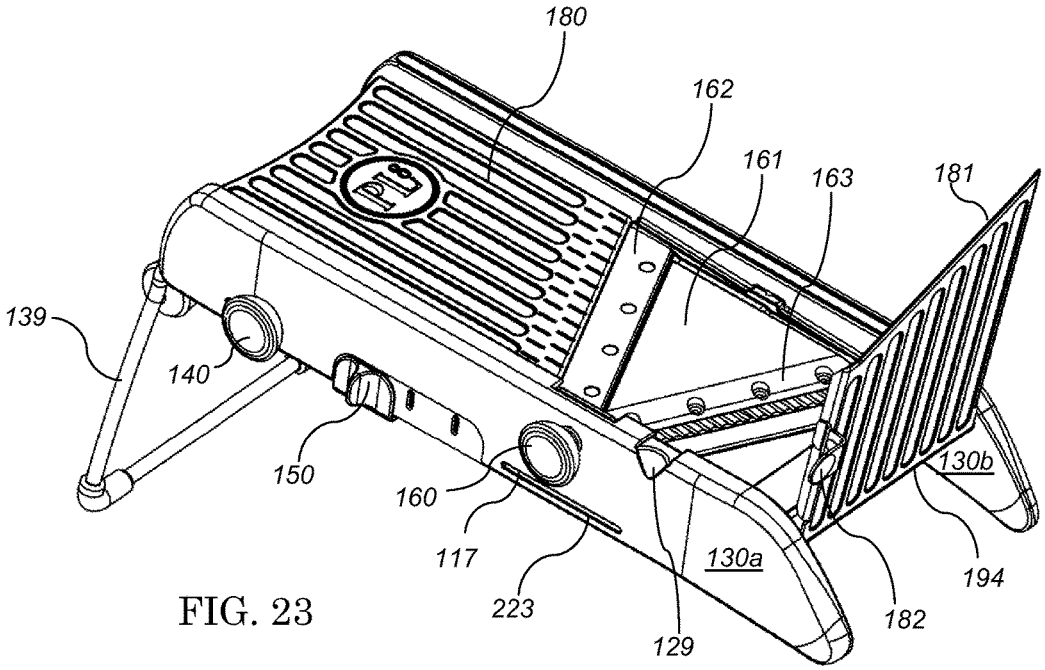
FIG. 23 is a perspective view of the alternate preferred mandolin slicer, shown with the runout plate rotated upward and a main blade frame in a first deployed position.

With reference to FIG. 23, the main blade frame 161 is configured in a first position in which the main blade 162 is adjacent the platen 180 and the second blade 163 is positioned away from the platen. When the runout plate 181 is rotated upward into the position as shown in FIG. 23 (pivoting on axle 135, best seen in FIG. 16), the main blade frame is accessible for rotation.

Figure 24:
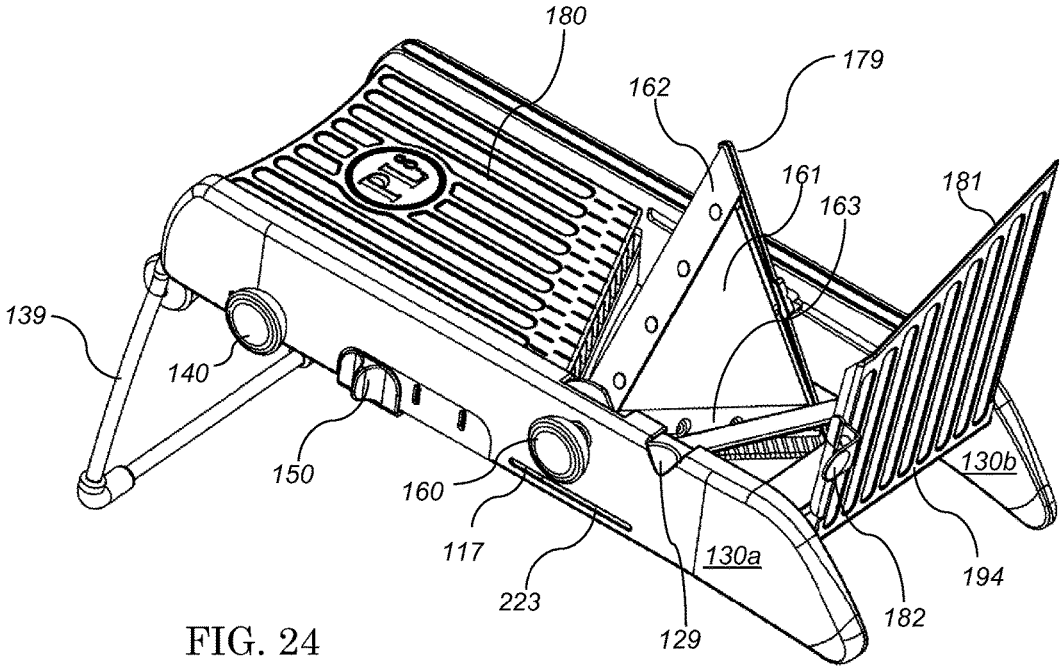
FIG. 24 is a perspective view of the alternate preferred mandolin slicer, shown with the runout plate rotated upward and a main blade frame in an intermediate position.

With reference to FIG. 24, the knob 160 is pulled outward and the main blade frame 161 is shown in an intermediate position of rotation in which the main blade 162 and second blade 163 are rotated out of the plane formed by the platen and runout plate. From this position the main blade frame can continue its rotation until it is flipped 180 degrees from the orientation from FIG. 23, resulting in the orientation shown in FIG. 25. In this configuration, the second blade 163 is now adjacent the platen and the main blade 162 is extending away from the platen.

Figure 25:
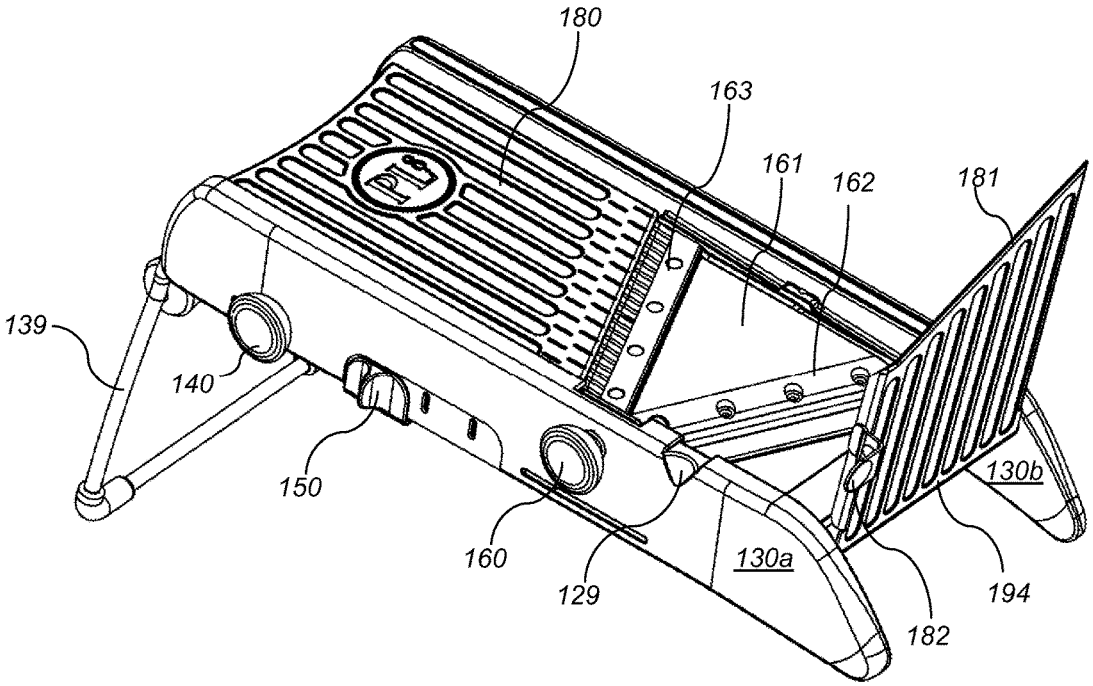
FIG. 25 is a perspective view of the alternate preferred mandolin slicer, shown with the runout plate rotated upward and a main blade frame in a second deployed position.
Figure 26:
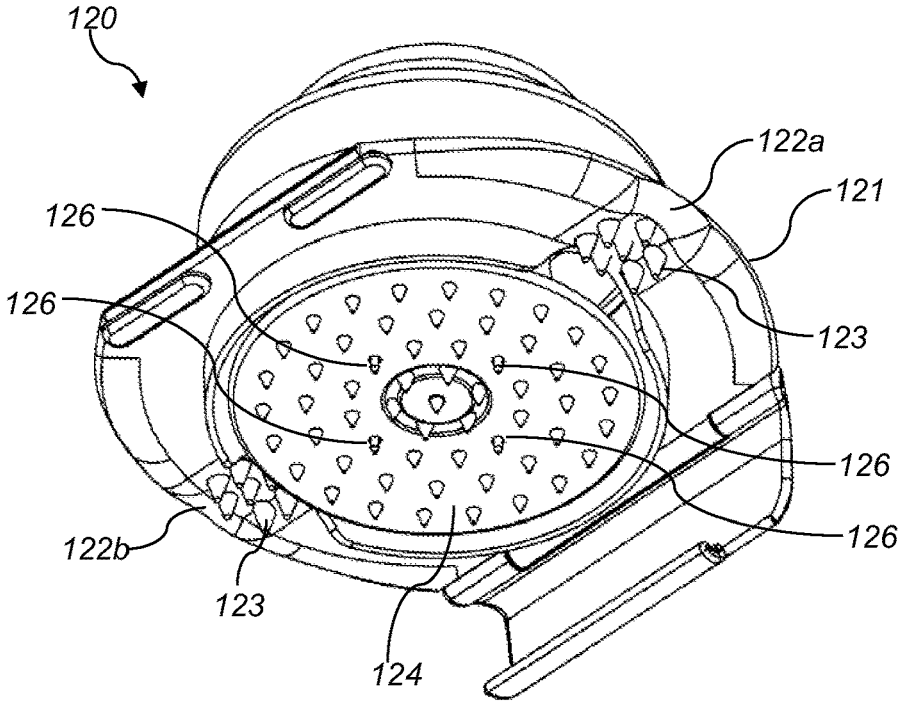
FIG. 26 is a bottom perspective view of a preferred pusher.
Figure 27:
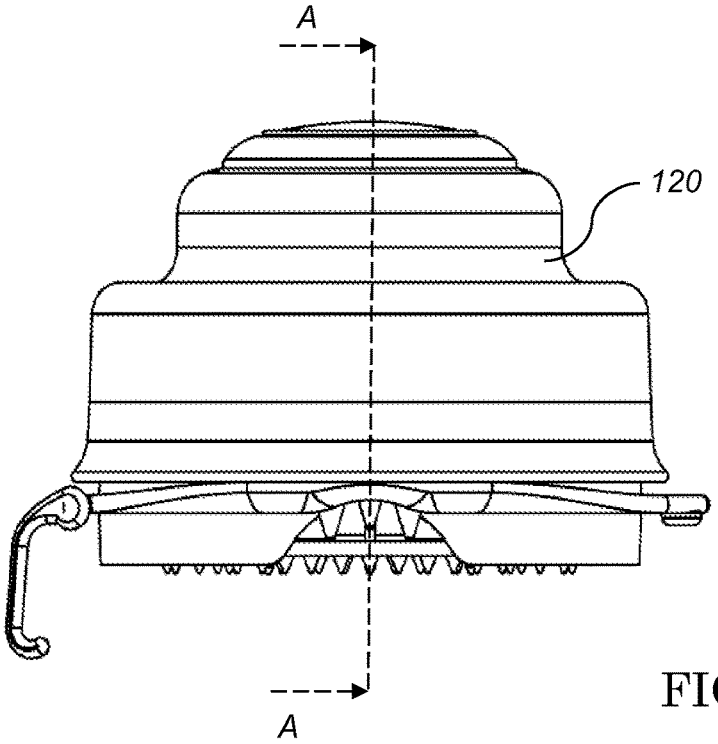
FIG. 27 is a front plan view of the pusher of FIG. 26.
Figure 28:
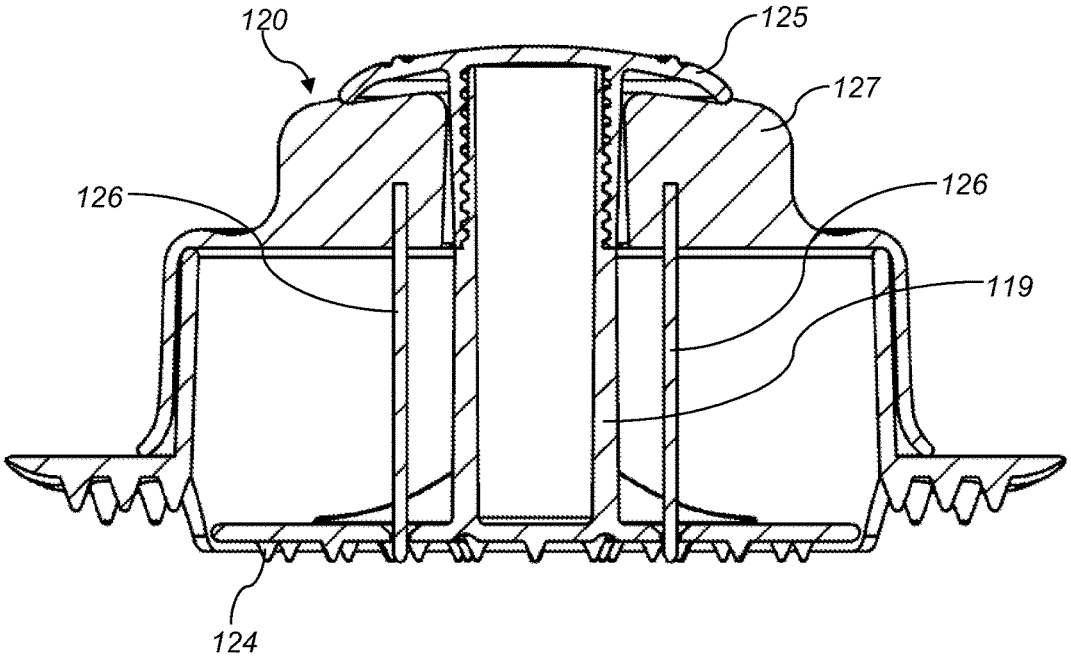
FIG. 28 is a sectional view along plane A-A in FIG. 27.

When the main blade frame is rotated into a desired position, the knob is pressed back inward by the urging force of the spring, causing the fin to be received within the channel to lock the main blade frame in position as shown in FIG. 25. The runout plate can then be rotated back down on top of the main blade frame 161 so that the slicer can be used with the second blade 163.

In one version of the invention, a pair of rows of vertical blades is also provided. The two rows of vertical blades are spaced apart from one another such that the blades of the second row are positioned in which the individual blades alternate between the blades of the first row when both rows of vertical blades are raised above the platen. As such, a food item will be cut into strips that are twice as wide when only the first row of blades is raised as they will be cut with both rows of blades raised. In one example, the blades in each frame are spaced apart by 8 mm, such that when both frames are raised the staggered spacing produces a blade spacing of 4 mm. The blades may be spaced wider or closer in other versions, and in some versions the blades are spaced differently on the first row of blades than on the second row of blades. The 8 mm spacing is more useful for cutting potatoes into strips or fries, and therefore the blade spacing may be considered to be for fries. When used together, they may be more suitable for julienne cutting. As such, the first blade frame may be referred to as a fry blade frame while the second blade frame may be referred to as a julienne blade frame. In other versions, the blades may be spaced farther apart or moved closer together in accordance with the invention.

A first blade frame 170 is sized to extend across the opposing left and right sidewalls of the frame, with a plurality of short blades 170*a* extending vertically from the blade frame. The first blade frame includes a pair of pegs 173, 175 extending outwardly from each of the opposing ends of the frame. A second blade frame 171 is likewise configured with a plurality of vertical blades 171*a* and a pair of pegs 173, 175 extending outwardly from each opposing end.

Figure 20:
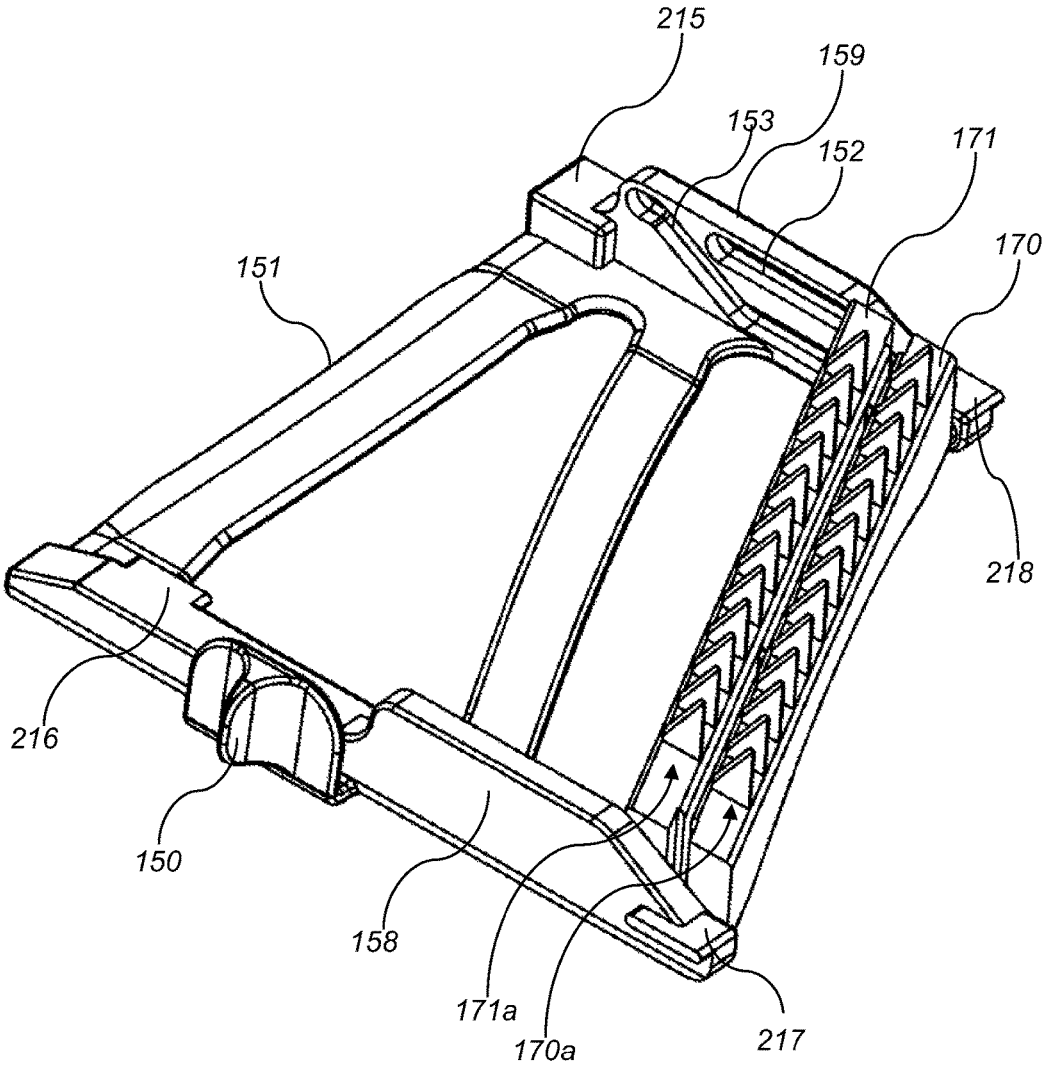
FIG. 20 is a perspective view of a julienne blade selector with sets of julienne blades in which both sets of julienne blades are in a retracted position.
Figure 21:
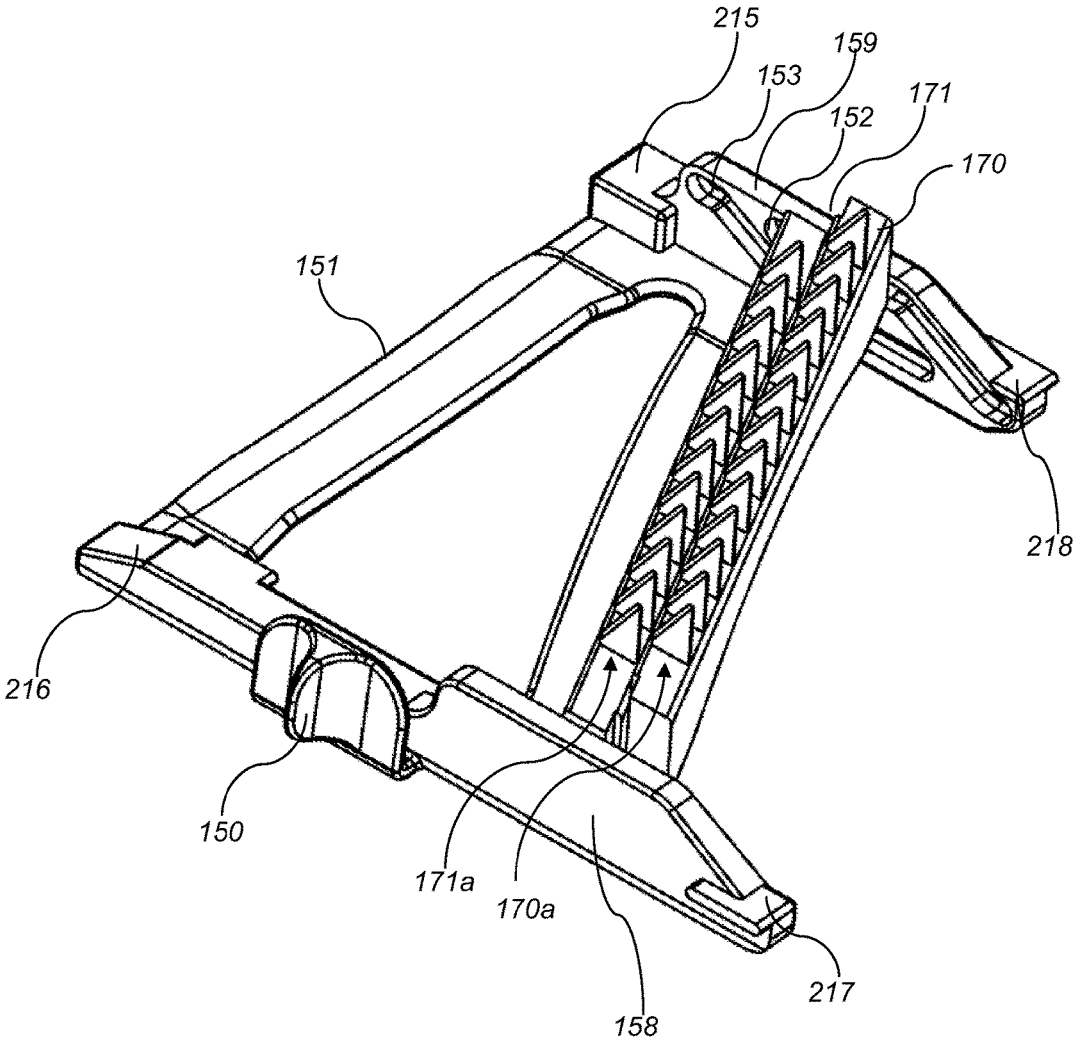
FIG. 21 is a perspective view of a julienne blade selector shown with one set of julienne blades in a retracted position and one set of julienne blades in an extended position.
Figure 22:
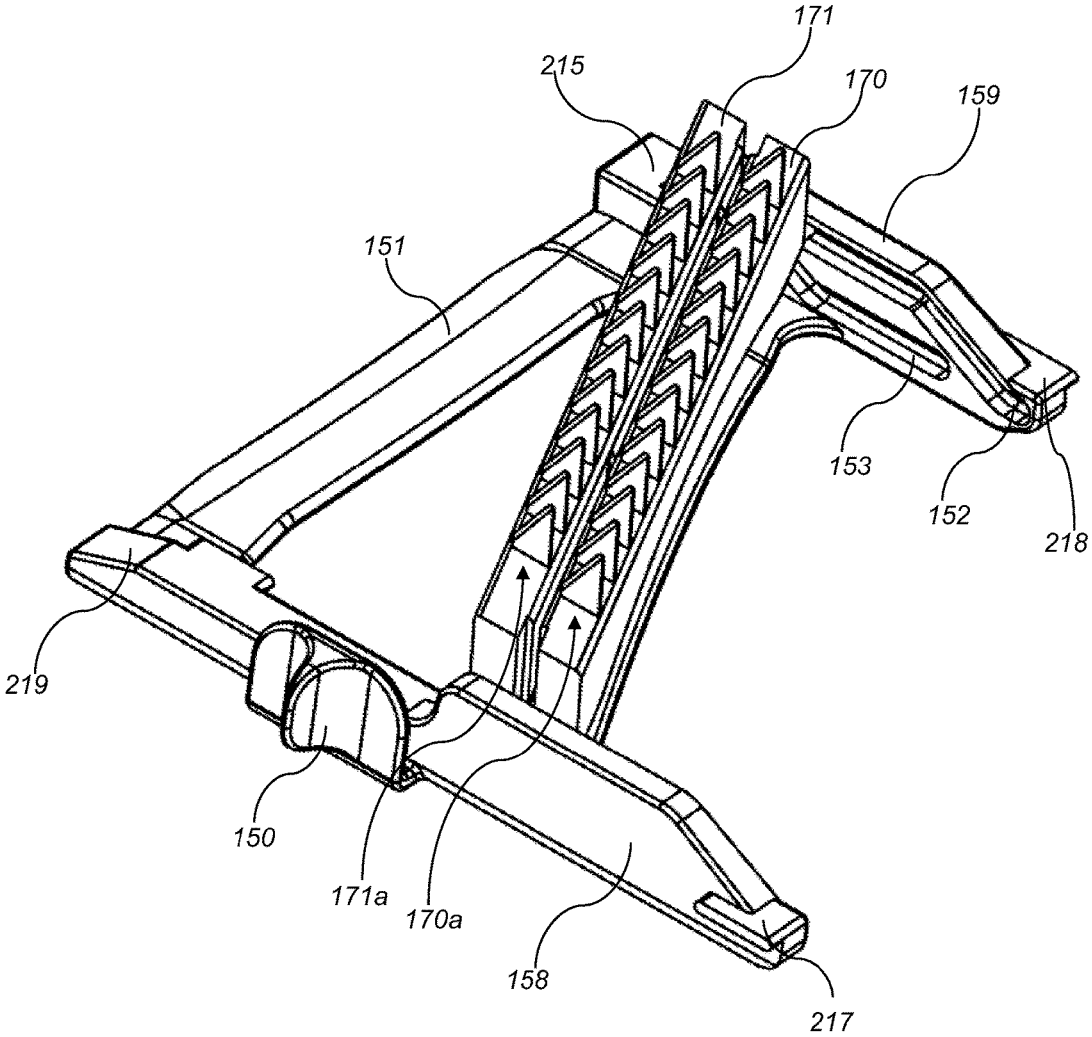
FIG. 22 is a perspective view of a julienne blade selector shown with both sets of julienne blades in an extended position.

The pegs of the first and second vertical blade frames are received within channels formed in a fry/julienne selector 151, as best seen in FIGS. 20-22. The selector is referred to as a fry/julienne selector because, as described above, it allows a user to selectively raise one or both sets of vertical blades to control the width of food items cut by the vertical blades.

A first channel 152 is positioned on a first side and configured with a first horizontal portion and a second inclined portion. A complementary second channel is formed on a second side of the fry/julienne selector, configured in the same manner. A third channel 153 is positioned on the first side and is configured with a first inclined portion and a second horizontal portion. A complementary fourth channel is formed on the second side and configured in the same manner.

The pegs of the first julienne frame 170 are positioned in the first and second channels, while the pegs of the second julienne frame 171 are positioned in the third and fourth channels. In each case, the first and second julienne frames are configured to slide along the corresponding channels such that they are extended upward through the platen when they travel to the top of the inclined portion, and they extend below the platen when they travel to the bottom of the inclined portion. The julienne frames are further configured to be restricted against movement in a direction forward or backward along the slicer, and instead occupy a fixed position axially along the length of the slicer. This fixed position corresponds to the location of the blade slots 131, 132 formed in the platen. Thus, the selector 151 moves fore and aft while the blade frames remain fixed, such that fore and aft movement of the selector causes the blade frames to move upward or downward in the selector channels.

At a first position as shown in FIG. 20, the selector is closest to the rear of the slicer (that is, toward the platen and away from the runout plate) and both frames 170, 171 are in the recessed position, with no blades extending above the platen.

As shown in FIG. 21, as the selector 151 travels toward the forward end of the slicer (that is, toward the runout plate) and into the second selector position, the first frame 170 travels up the first inclined portion of the first and second channels 152, raising the first set of blades upward and through the second set of holes 132 formed in the platen. Meanwhile, the second frame 171 initially moves along the horizontal portion of the third and fourth channels 151, which is below the horizontal portion of the first and second channels. This initial horizontal movement maintains the second set of blades in a recessed position while the first set of blades is raised. If desired, the user can maintain the blades in this position, with the first set of blades raised and the second set retracted.

Finally, as shown in FIG. 22, as the selector 151 travels farther toward the forward end of the slicer, into the third position, the first frame 170 travels along the upper horizontal portion of the first and second channels 152, and because the upper portion of the channel is horizontal it maintains the first frame in the raised position. Meanwhile, the second frame travels along the inclined portion of the third and fourth channels 153, raising the second frame and its blades above the upper surface of the platen.

A tab 150 or knob is attached to or integrally formed with the selector, and is positioned outside the frame so that the user can slide the tab (and therefore the selector) axially forward and backward along the slicer to raise and lower the blades. In the illustrated version, the frame includes external markings corresponding to tab locations for retracted, one blade frame raised, and two blade frame raised positions as described above.

In one version of the invention, the selector 151 is trapped within hollow sidewalls and supported by a lower interior sidewall edge, as described below. The hollow interior sidewall is partially visible, for example, in FIG. 16 through open channels 211, 212 within frame sidewall 130*b*. The selector 151 is formed with opposing vertical sidewalls 158, 159, with the channels 152, 153 being formed in the interior-facing surfaces of the opposing vertical sidewalls. The left and right frame sidewalls 130*a*, 130*b* are formed with a hollow interior that is sized and shaped to receive the vertical sidewalls 158, 159 of the selector 151 for sliding axial movement of the selector sidewalls within the frame sidewalls.

Most preferably, the selector includes a plurality of retaining surfaces 115-118 formed as horizontal flanges extending inward or outward (or both) from the selector. The retaining surfaces form abutments that ride along a corresponding shelf or groove formed within the interior sidewalls of the frame in order to retain the selector within the opposing frame sidewalls and define a linear path of travel of the selector within the frame. An opening in the lower edge of the frame sidewalls 130*a*, 130*b* allows the bottom of the selector to extend through the frame while the abutments 115-118 trap the vertical uprights 158, 159 and channels 152, 153 within the frame sidewalls.

Figure 15:
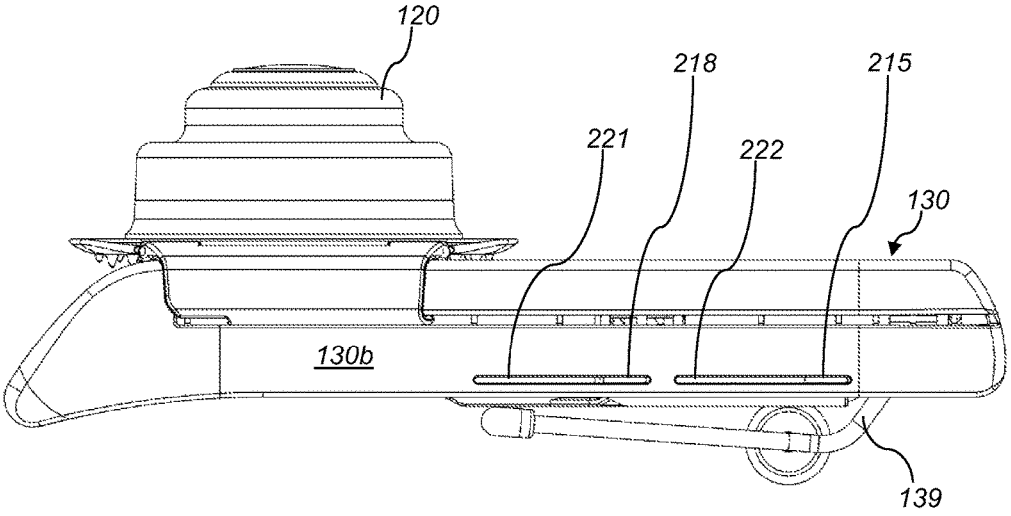
FIG. 15 is a side view of the alternate preferred mandolin slicer, shown with a folding leg in a retracted position.

In the illustrated version, a first horizontal channel 223 is formed within the right frame sidewall 130*a*, as best seen in FIG. 16. A second horizontal channel in the right sidewall is formed within the frame on an interior side and not visible in FIG. 16. A pair of opposing third and fourth channels 221, 222 are formed in the left frame sidewall 130*b*, as seen in FIGS. 15 and 16. The horizontal tabs 216 and 218 are seated within the third and fourth channels 222, 221 (respectively) as best seen in FIG. 15. An abutment 217 on the opposite side of the selector 151 is seated within the horizontal channel 223 formed in the right sidewall frame member 130*a*, as best seen in FIG. 24. The abutments slide forward and rearward within the channels as the selector knob 150 is moved forward and rearward, thereby moving the selector 151 forward and rearward along a fixed horizontal plane parallel to the plane of the runout plate (or distal ramp portion).

The frame preferably includes an interior downwardly extending vertical post 210 having a pair of cutouts 211, 212 formed on each side of the vertical post, as best seen in FIG. 16. In the illustrated version, the frame sidewalls are hollow and are configured to receive within the hollow interior the left and right selector uprights defining the channels as described above. The channels 152, 153 face inward and are accessible through the cutouts 211, 212. The first cutout 212 is sized to receive the first vertical blade frame 170, allowing for vertical movement of the frame within the cutout. The vertical edges of the cutout (one of which is on the post 210) prevent movement of the blade frame 70 in a forward or rearward direction. Similarly, the second cutout 210 receives the second blade frame 171, trapping it in position to allow vertical but not longitudinal movement. Accordingly, movement of the selector causes movement of the blade frames 170, 171 within the channels without longitudinal movement of the frames 170, 171 because they are constrained by the cutouts 211, 212 formed in the frame sidewalls. As a result, movement of the selector with respect to the blade frames causes vertical movement of the blade frames, depending on the location of the frames in the channels as described above.

The pusher 120 includes an upper pusher grip having a number of spikes extending through a pusher core. The core terminates in a plate 124 that extends through a pusher frame having a lower flange 121 to protect the user from contacting the blade.

The spikes 126 are embedded in the pusher grip 127, and in the illustrated version four spikes 126 are provided. The spikes are preferably formed from metal and are elongated to firmly retain a food item within the pusher frame. The pusher plate 124 includes a series of holes 128 positioned to receive the spikes so that the spikes can extend through the pusher plate.

The pusher core includes a central post 119 terminating in a pusher top 125, with the pusher central post being vertically moveable through the pusher grip 127. In a vertically raised position the spikes 126 are exposed through the pusher plate 124, allowing the spikes to readily poke into a food item. The pusher plate 124 may further include a number of short spikes integrally formed with the pusher plate.

As the pusher top and pusher core are pressed downward it urges the food item onto the platen and through the pusher. After extended slicing the pusher core moves downward to the bottom of the pusher frame.

In one version of the invention, the pusher frame includes an arch 122*a*, 122*b* at the leading and trailing edges. The arch is configured to allow the pusher frame to grasp an elongated food item such as a carrot, positioned lengthwise through the arches. Each of the arches may further include a number of short spikes 123 extending downward from the arches.

In use, the platen may be raised or lowered to a desired height, thereby selecting a desired cutting thickness by lowering the platen beneath the main blade. As noted above, the platen lowers in a vertical manner, rather than inclining, thereby producing less binding when slicing. Also as desired, the blade frame may be rotated to choose either of the two blades. The julienne and fry blades may also be raised or retracted to allow for standard cutting or cutting with additional julienne or fry stripping.

Figure 30:
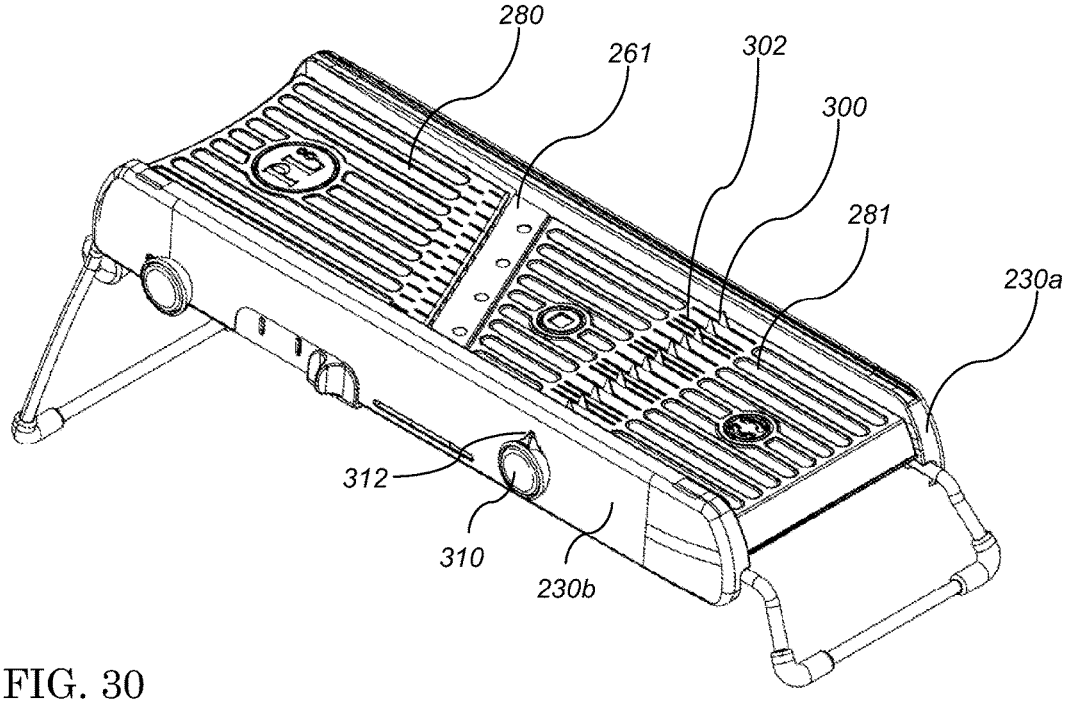
FIG. 30 is a top perspective view of an alternate version of a mandolin slicer, shown with a first set of cubing blades extended.

Some versions of the invention may incorporate a set of cubing blades, such as illustrated in a further preferred embodiment in FIGS. 30-45. FIG. 30 illustrates an alternate preferred mandolin slicer having a frame with left and right frame sidewalls 230*a*, 230*b*. A movable platen 280 is positioned between the frame sidewalls to allow a food item to be guided along the platen toward a main slicing blade 261. A runout plate 281 is positioned at a distal end of the slicer, such that the main slicing blade is positioned between the proximal end and the distal end of the slicer. A series of cubing blade slots 302 is positioned in the runout plate, with the slots being configured to allow a plurality of cubing blades to extend vertically through the cubing blade slots. In the illustrated example of FIG. 30, a first set of cubing blades 300 is shown in an extended position in which the blades extend perpendicularly to the runout plate and through the series of cubing blade slots 302 arranged parallel to one another between the left and right frame sidewalls. In one version, the first set of cubing blades 300 are relatively close together for a relatively small cube to be produced by slicing a food item with the cubing blades. A knob 310 positioned on the cubing blade assembly (see FIGS. 42-45) extends through an opening formed in the right frame sidewall 230*b*, as described in greater detail below. The knob preferably includes an indicator 312 providing a visual indication of the selection of cubing blade options.

Figure 31:
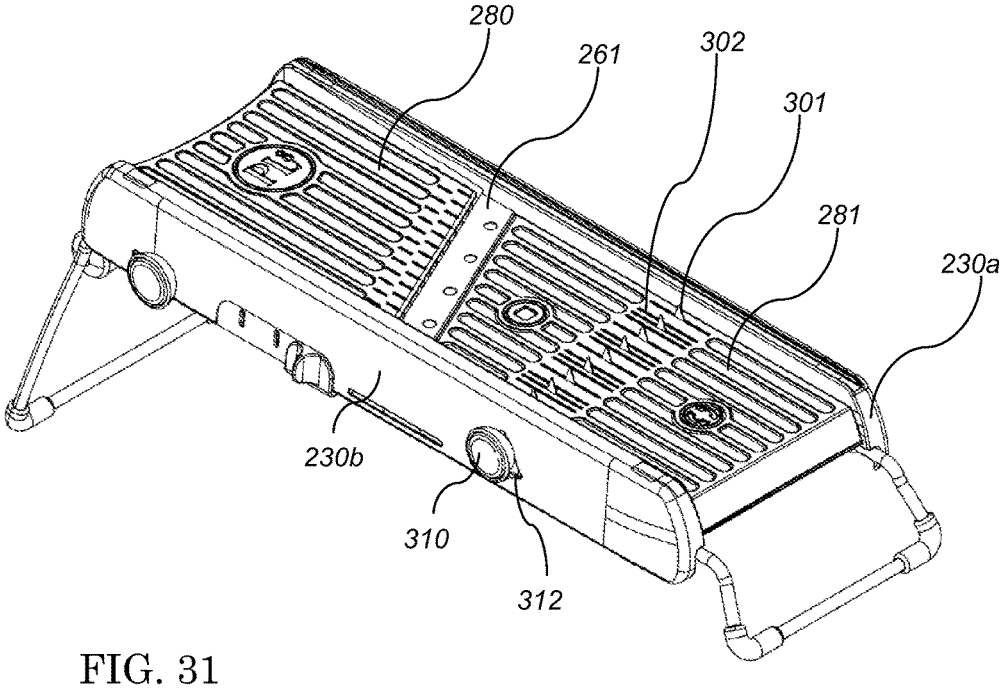
FIG. 31 is a top perspective view of the slicer of FIG. 30, shown with a second set of cubing blades extended.

FIG. 31 illustrates the slicer of FIG. 30, but with a second set of cubing blades 301 extending through the series of cubing blade slots 302. Likewise, the first set of cubing blades 300 has been retracted below the runout plate in FIG. 31. Thus, in the illustrated example the slicer includes at least two sets of cubing blades. In other versions a single set of cubing blades may be provided, or more than two sets may be provided. In FIG. 30, the indicator 312 is pointing in a vertical position, while in FIG. 31 the indicator is rotated 90 degrees in a clockwise direction from the position in FIG. 30.

Figure 32:
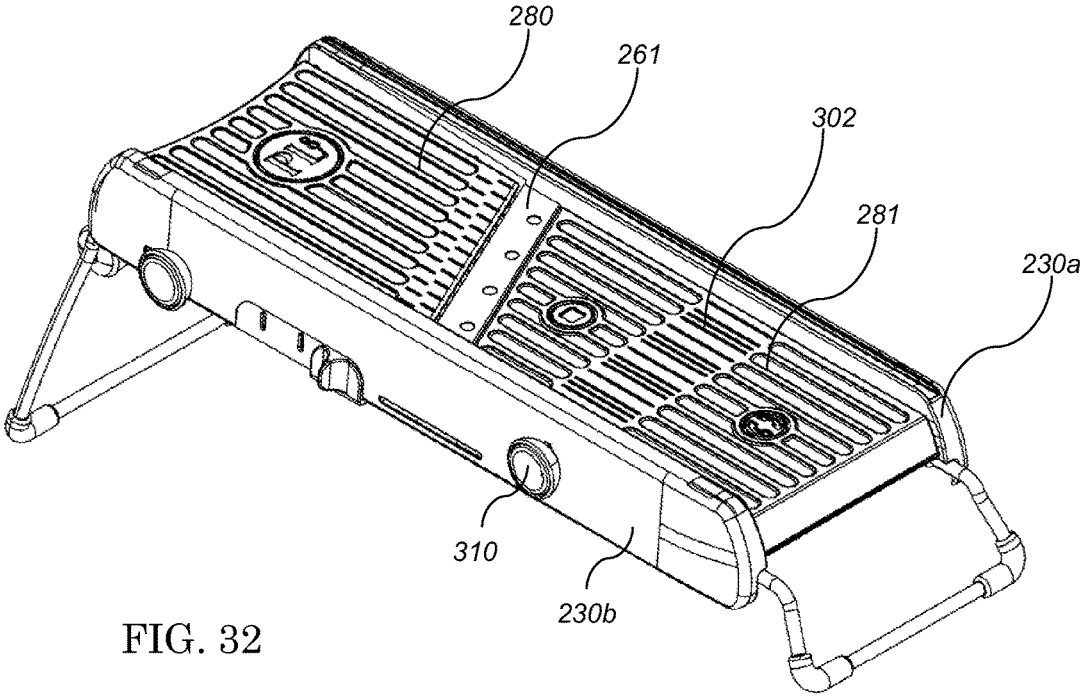
FIG. 32 is a top perspective view of the slicer of FIG. 30, shown with the first and second sets of cubing blades retracted.

FIG. 32 illustrates the slicer of FIG. 30, but with both the first and second set of cubing blades in a retracted position, beneath the runout plate.

Figure 33:
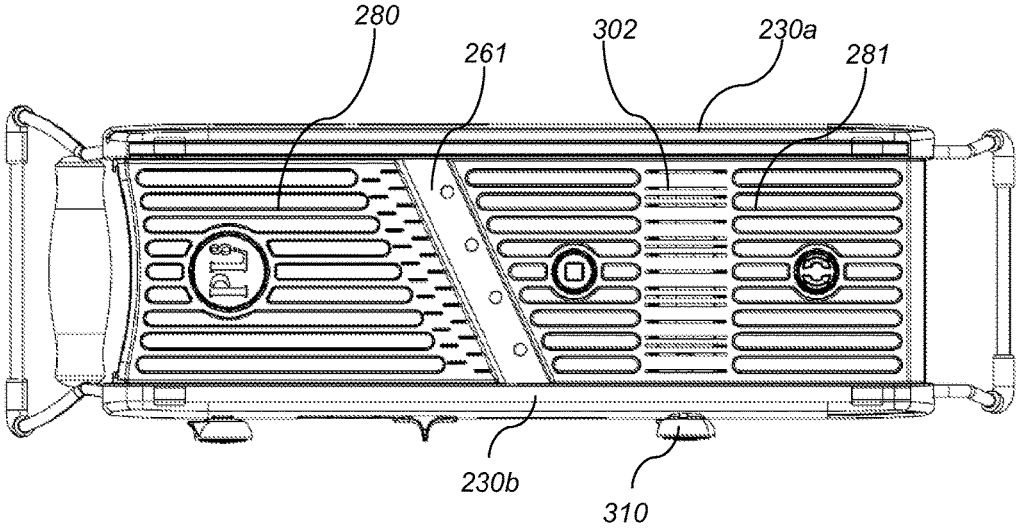
FIG. 33 is a top plan view of the slicer of FIG. 30.
Figure 34:
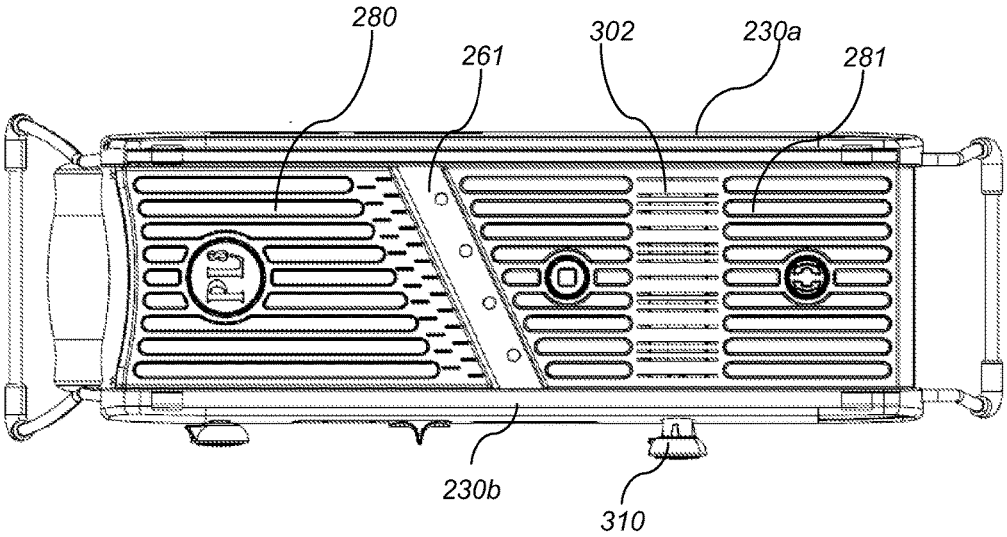
FIG. 34 is a top plan view of the slicer of FIG. 30, shown with a cubing adjustment knob in an extended position.

FIGS. 33 and 34 are top plan views of the slicer of FIG. 30, highlighting the position of the cubing selector knob 301 in its locked position in FIG. 33, and in an extended position in FIG. 34 in which one or more protrusions has been removed from corresponding slots (as described further below) so that the knob and the cubing blade assembly may be rotated as desired.

FIG. 35 is a bottom perspective view of the slicer of FIG. 30, with the cubing blade selector removed and highlighting the interior portion of the left frame sidewall 230*a*. As described above, most preferably the sidewall is formed with in inner and outer surface defining an interior cavity. Detail D36 is indicated by a circle in FIG. 35, and is shown in a close-up view in FIG. 36. The interior portion of the left frame sidewall 230*a* includes a hole 240 configured to receive a portion of an axle for supporting the cubing blade assembly, as discussed below.

Figure 37:
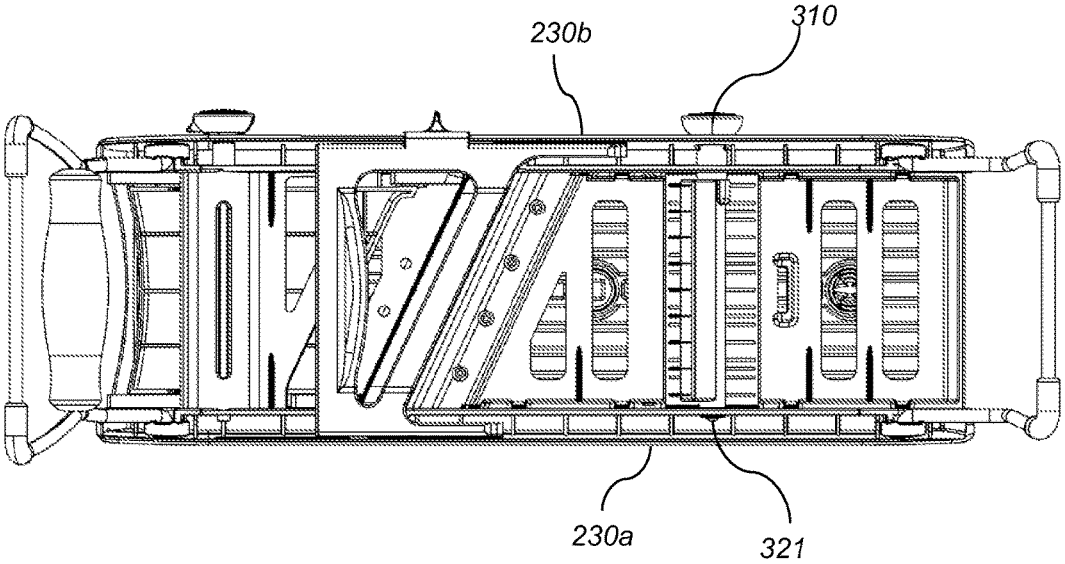
FIG. 37 is a bottom plan view of the slicer of FIG. 30.

FIG. 37 is a bottom plan view of the slicer of FIG. 30, illustrating the cubing blade selector knob 310 extending beyond the right frame sidewall 230*b* and a first end 321 of the selector assembly axle extending into the interior cavity of the left frame sidewall 230*a*.

Figure 38:
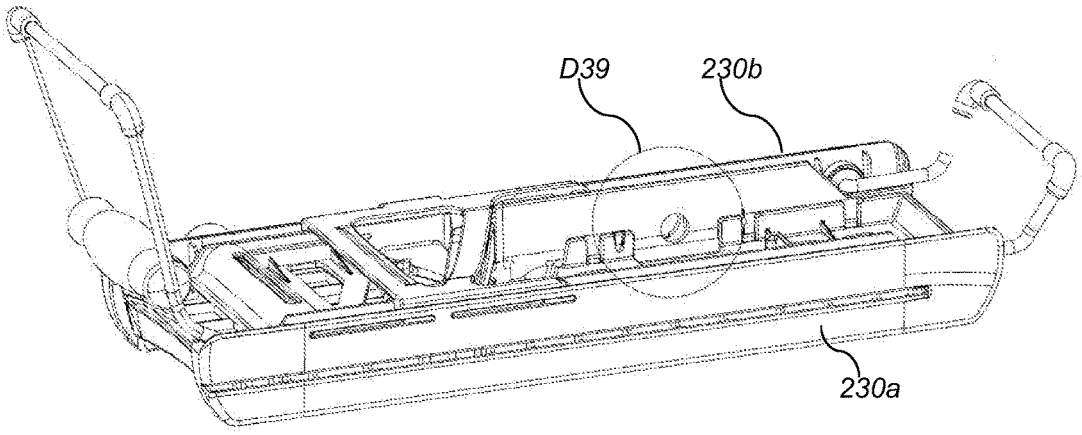
FIG. 38 is a bottom perspective view of the slicer of FIG. 30, indicating detail D39.
Figure 39:
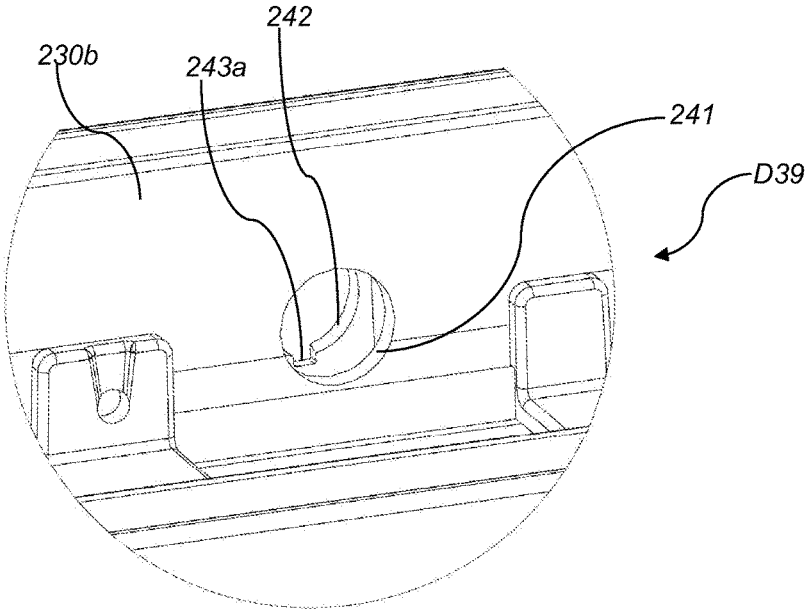
FIG. 39 is a close-up view of detail D39 as indicated in FIG. 38.

FIG. 38 is a bottom perspective view of the slicer of FIG. 30, with the cubing blade selector removed and highlighting the interior portion of the right frame sidewall 230*b*. Detail D39 is indicated by a circle in FIG. 38 and is shown in close-up view in FIG. 39. As with the left frame sidewall, the right frame sidewall is preferably formed with inner and outer surfaces defining an interior cavity. On the inner sidewall surface, an inner circular hole 241 is formed, while in the outer sidewall surface an outer circular hole 242 is formed. Preferably, one of the inner or outer holes is formed with one or more notches, e.g. 243*a*, to receive protrusions formed on the selector knob to lock the cubing blade assembly in a desired position. In the illustrated example, the notches are formed in the outer hole 242.

Figure 40:
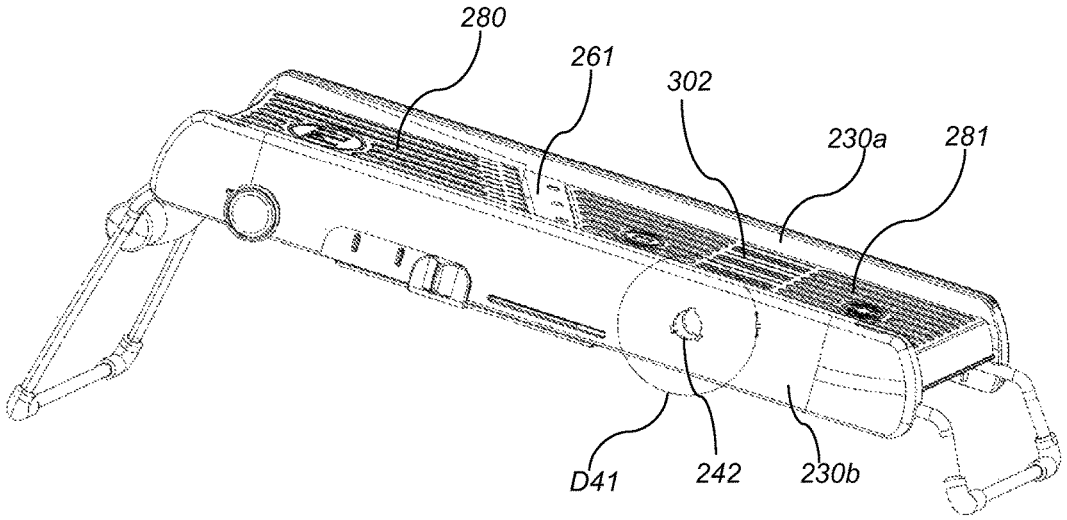
FIG. 40 is a top perspective view of the slicer of FIG. 30, indicating detail D41.
Figure 41:
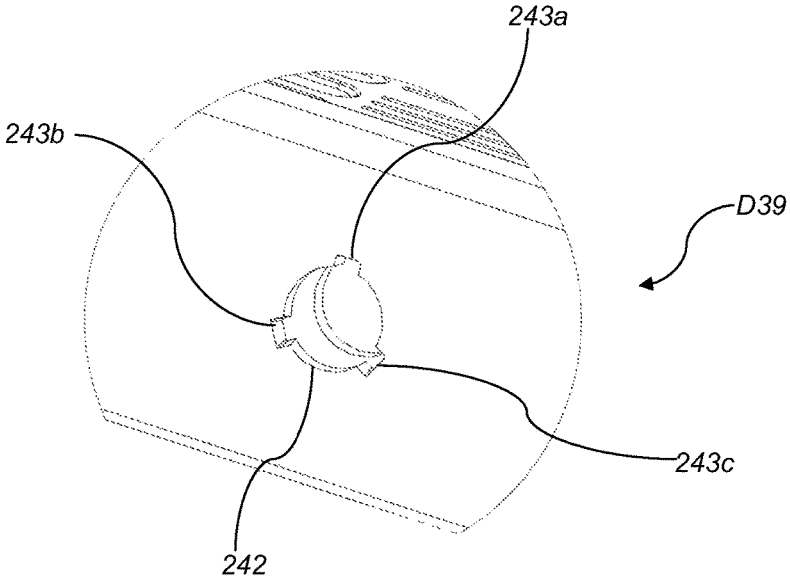
FIG. 41 is a close-up view of detail D41 as indicated in FIG. 40.
Figure 42:
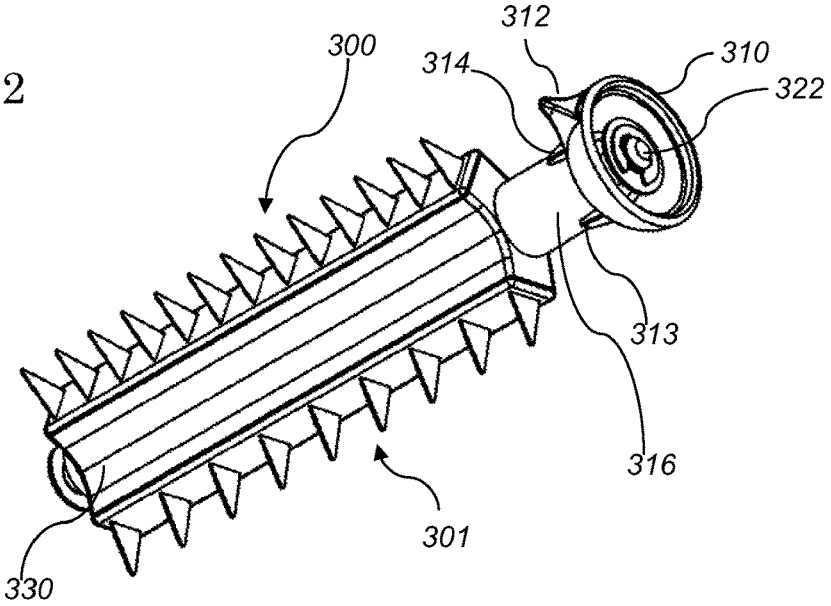
FIG. 42 is a perspective view of a preferred cubing blade assembly.
Figure 43:
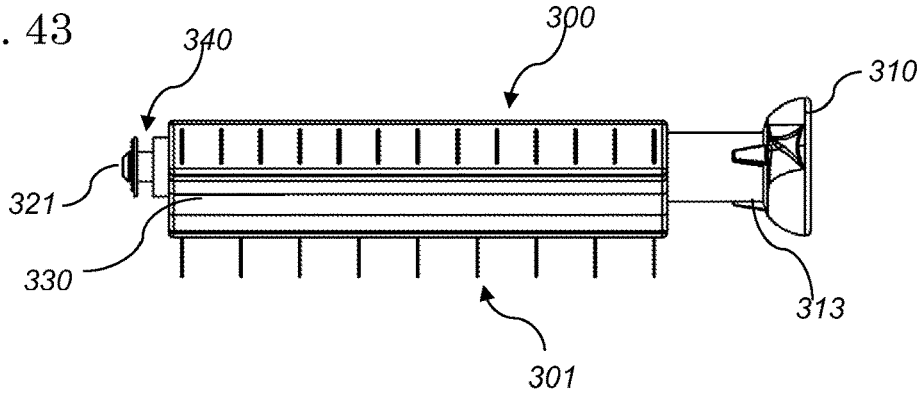
FIG. 43 is a front plan view of the cubing blade assembly.
Figure 44:
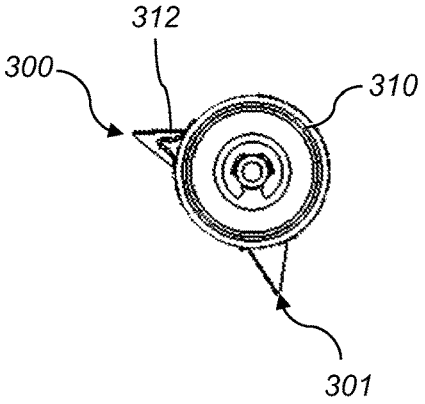
FIG. 44 is a right side view of the cubing blade assembly.
Figure 45:
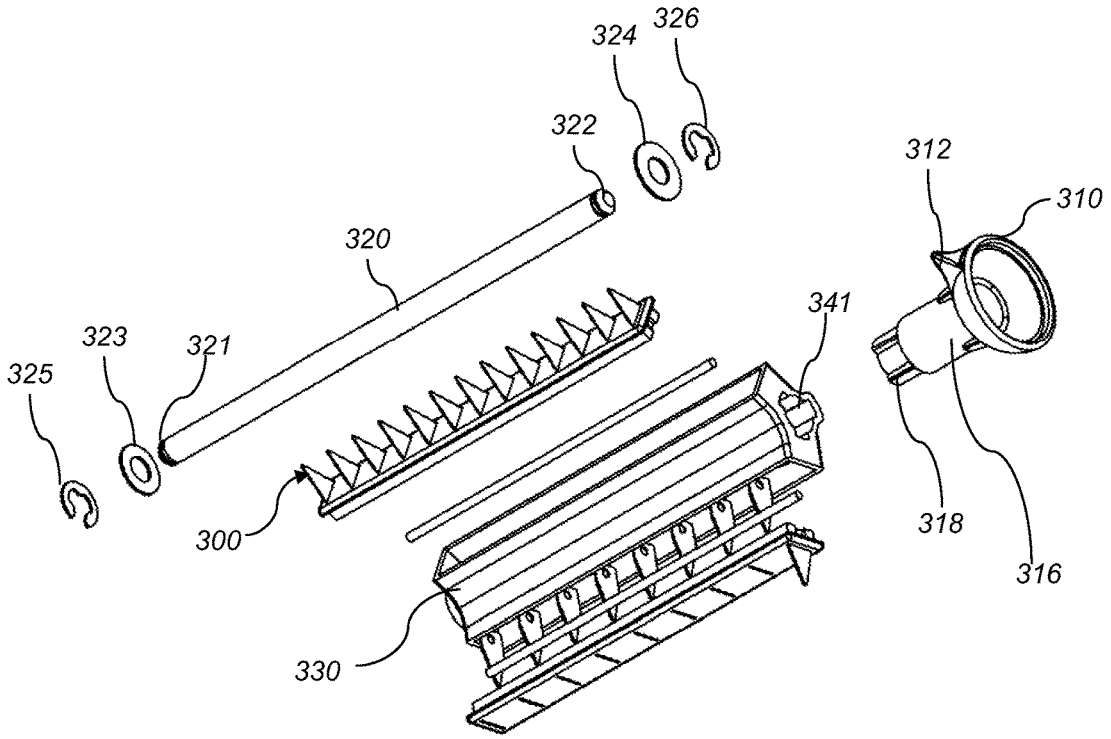
FIG. 45 is an exploded perspective view of the cubing blade assembly.

FIG. 40 is a perspective view of the slicer of FIG. 30, with the cubing blade assembly removed and including a circle indicating detail D41. FIG. 41 shows a close-up view of detail D41. The outer circular hole 242 formed in the right frame sidewall 230*b* is preferably formed with three notches 243*a*, 243*b*, 243*c*, as illustrated in FIGS. 40 and 41.

FIGS. 42-45 illustrate a preferred blade assembly, which includes a blade assembly body 330 carried on a center axle 320 having a first end 321 and a second end 322. The axle is received within a central axial bore formed in the blade assembly body. In the illustrated version, a washer 323 is secured to the first end 321 of the axle 320 by a clip 325. Another washer 32 is secured to the second end 322 of the axle 320 by another clip 326. The second end of the axle extends into the interior of the selector knob, in which a coil spring (not illustrated) is trapped between the washer 324 and an interior shelf formed within the knob 310.

The main body 330 is configured to mount a first set of blades 300 and, in the illustrated example, a second set of blades 301. Most preferably the first set of blades contains a larger number of blades that are spaced more closely together than the relatively fewer blades in the second set of blades, which are spaced farther apart. Accordingly, the first set of blades will slice a food item into smaller cubes than the second set of blades.

At the first end of the cubing blade assembly, a short length of the axle 320 extends between an end of the main body 330 and the first washer, defining a gap 340. This short length of the axle is carried on the left sidewall frame 230*a*, supported within the hole 240, such that the washer 323 and the main body 330 retain the cubing blade assembly in position and substantially prevent moment of the cubing blade assembly in an axial direction (that is, a direction along the axis defined by the axle 320). At the same time, the cubing blade assembly is mounted for rotational movement about the axis defined by the axle.

The cubing blade selector knob 310 includes a stem 316 which terminates in a splined section 318. The main body 330 is formed with a complementary interior opening having a series of grooves that receive the splines to lock the selector knob within the main body to prevent rotational movement of the knob with respect to the main body. At the same time, the knob 310 is configured to allow axial movement of the splined portion of the stem into and out of the main body. The second washer 324 trapped within the knob serves to limit the amount of axial movement of the knob with respect to the main body, while the interior coil spring is positioned between the second washer and the main body in order to urge the knob toward the main body.

The stem 316 of the knob is received within the holes 241, 242 formed in the right frame sidewall 230*b* in order to secure the blade assembly to the frame. A portion of the stem 316 axially outward from the splined portion of the knob includes one or more protrusions 313, 314 extending radially outward from the stem. The protrusions are sized and positioned to be received within the notches 243*a*, 243*b*, 243*c* formed in the outer sidewall hole 242. Accordingly, the protrusions and notches cooperate to prevent rotational movement of the knob, and therefore the axle and cubing blade assembly, when the protrusions are engaged within the notches.

In order to rotate the cubing blade assembly, the selector knob 310 is pulled outward, from its locked position as seen in FIG. 33 to its unlocked position shown in FIG. 34. This movement compresses the coil spring within the stem of the knob, and allows the axle and cubing blade assembly to be rotated. As desired by a user, the preferred version of the blade assembly may be rotated to positions in which all cubing blades are retraced, only the first set of cubing blades is extended, or only the second set of cubing blades is extended. Once rotated to the desired position, the knob is released and pulled back into position by the coil spring so that the notches and protrusions lock the cubing blade assembly in its selected position.

In one version of the invention, the individual blades in the sets of cubing blades are sharpened on two opposing sides, including an edge facing toward the proximal end of the slicer and an edge facing toward the distal end of the slicer. Consequently, the cubing blades are configured to cut when a food item is moved in either direction, either toward the distal end or toward the proximal end of the slicer.

Figure 46:
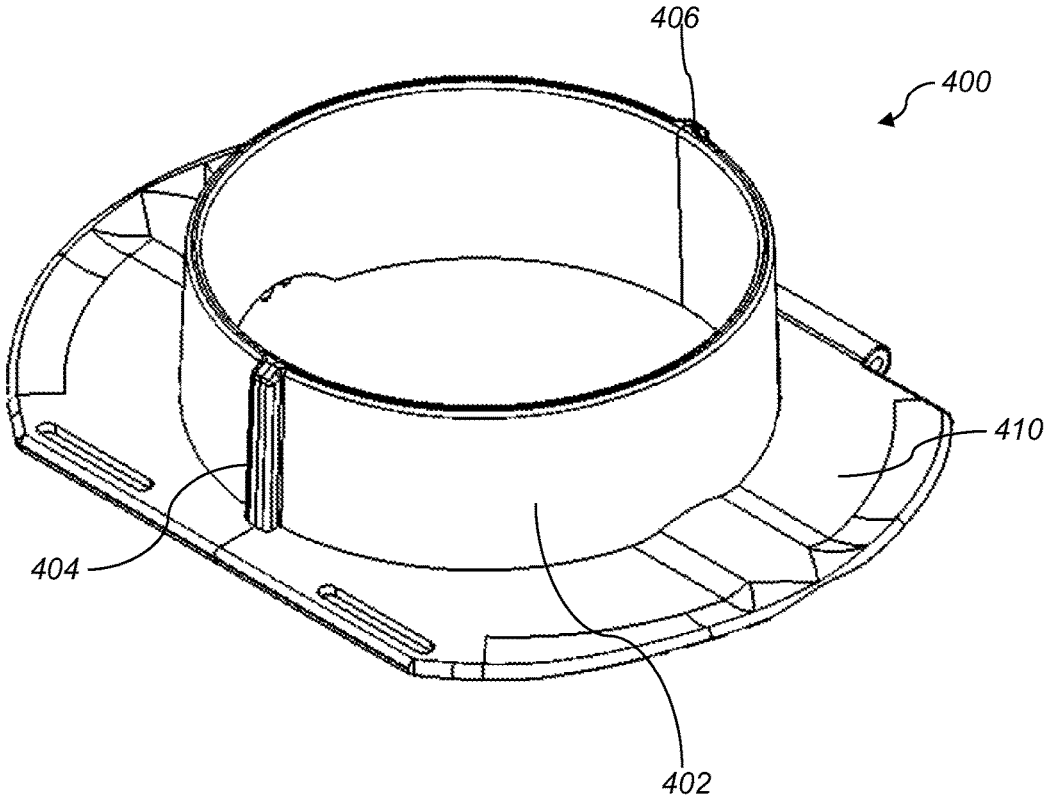
FIG. 46 is a perspective view of an alternate preferred pusher frame for use with a preferred slicer having a cubing blade assembly.
Figure 47:
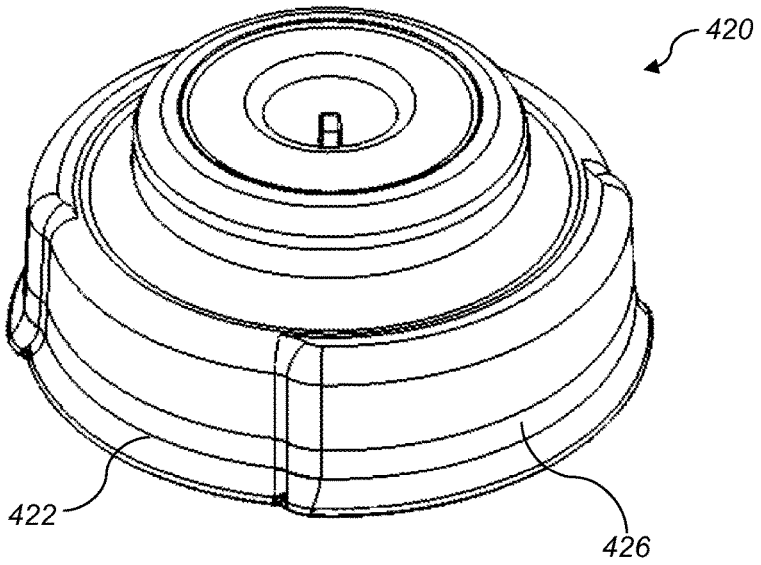
FIG. 47 is a perspective view of a preferred pusher grip for use with the pusher frame of FIG. 46.
Figure 48:
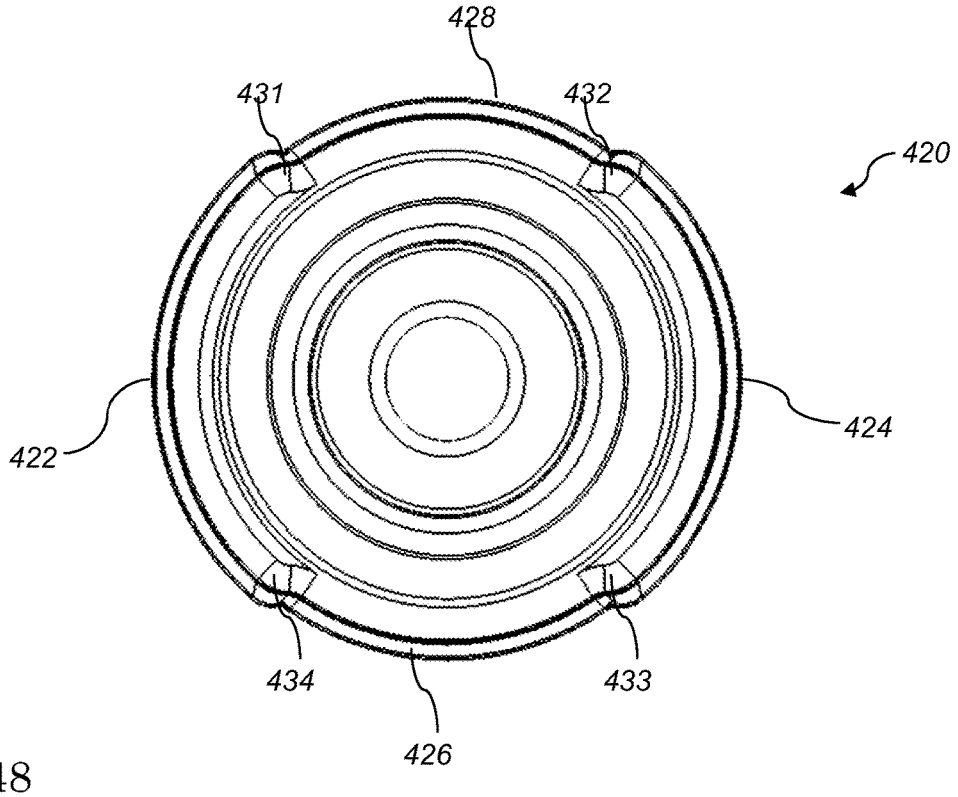
FIG. 48 is a bottom plan view of the pusher grip of FIG. 47.

Preferred pusher assembly components for use with a version having a set of cubing blades are illustrated in FIGS. 46 through 48. Most preferably, the pusher is configured as described and illustrated in FIGS. 26-29, but with differences as shown in FIGS. 46-48 and described below.

Figure 29:
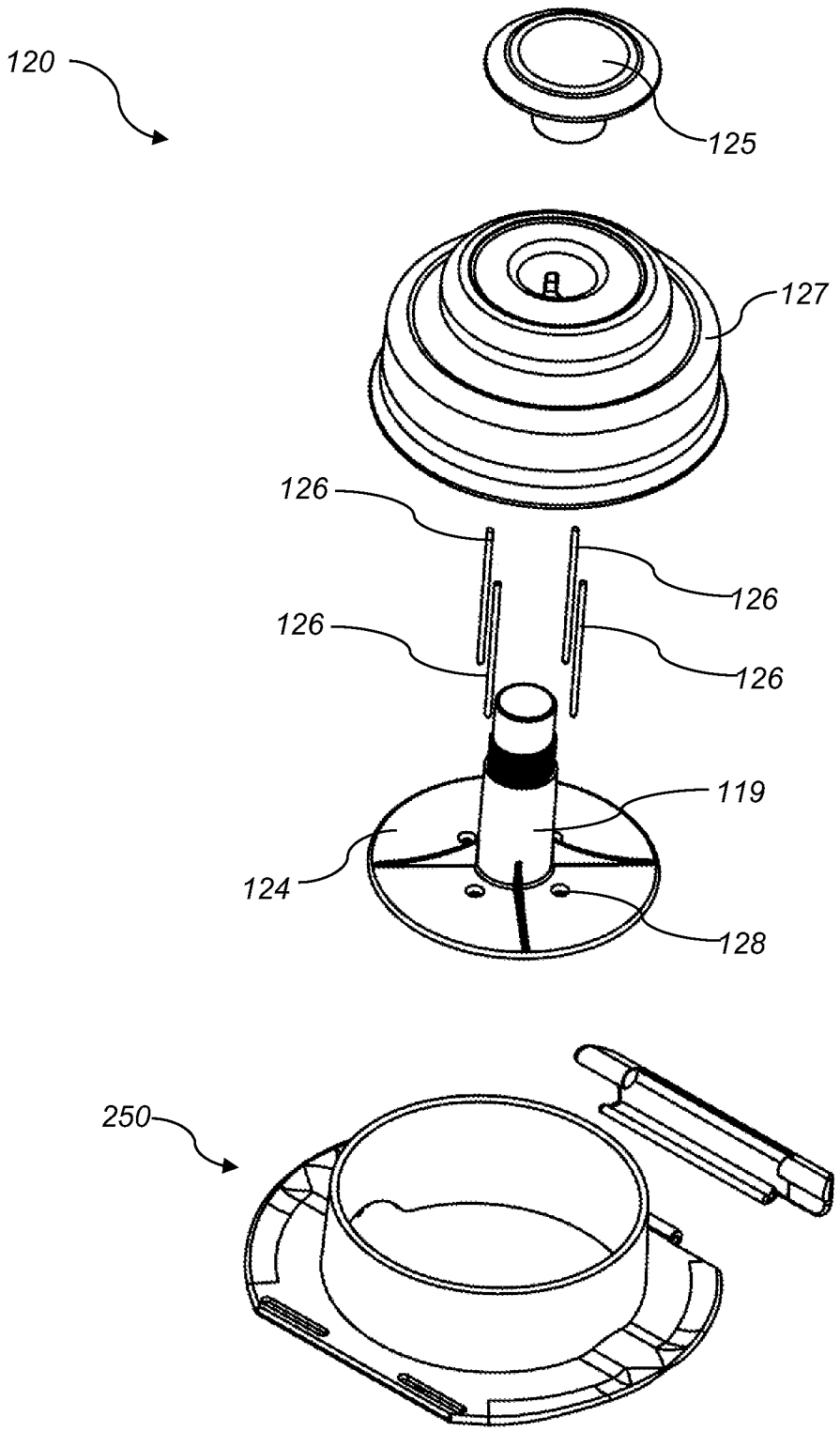
FIG. 29 is an exploded view of the pusher of FIG. 26.

The pusher assembly for use with a cubing version includes a pusher housing 400, generally configured as with the pusher housing 250 as illustrated in FIG. 29. The cubing pusher housing 400 includes a cylindrical support 402, as with the standard pusher, but it further includes a pair of diametrically opposed stops 404, 406 positioned on exterior sidewalls of the cylindrical support. As illustrated, the stops 404, 406 are preferably configured as axial tabs extending vertically along the height of the cylindrical support 402.

A pusher grip 420 is configured to be supported by the cylindrical support 402, in which the cylindrical support 402 is received within a complementary cylindrical interior cavity within the pusher grip 420. The pusher grip is configured with four sidewall sections, including a first pair of opposing sidewall sections 422, 424 and a second pair of opposing sidewall sections 426, 428, in which the first pair is positioned between the second pair. The first pair of sidewall sections is configured with a shorter interior diameter separating the sidewall sections than the length of the diameter separating the second pair of sidewall sections. The sidewall sections transition between one another to provide four abutments 431, 432, 433, 434 spaced about the generally cylindrical sidewall at 90 degree intervals and along an interior surface of the pusher grip 420. The abutments are sized to engage the stops 404, 406, such that the pusher grip may rotate axially atop the pusher housing but only for a rotational distance of 90 degrees. At that point the abutments engage the stops and further rotational travel is impeded. Although not illustrated in FIGS. 46-48, the pusher preferably also includes a pusher core and pusher plate as described above.

In use, a food item is preferably attached to the pusher plate and positioned to be moved along the platen and runout plate for slicing or cubing. If cubing is desired, the cubing knob 310 is pulled out and rotated to extend the desired set of cubing blades above the surface of the runout plate. The pusher and food item are moved over the runout plate, first in a direction from the proximal end toward the distal end of the slicer, causing the food item to be sliced by the set of cubing blades. The pusher grip is then rotated 90 degrees with respect to the pusher housing, thereby moving the food item 90 degrees because the food item is firmly grasped by the spikes or otherwise by the pusher plate as described above. The pusher is then moved in the opposite direction, toward the proximal end of the slicer, causing the food item to be sliced by the cubing blades again but in a cutting action that is perpendicular to the first cutting described above. At this point, the pusher should be positioned on the platen. Finally, the pusher is again moved from the proximal end and the platen toward the distal end, where the food item encounters the main slicing blade which will cut the food item into cubes. These steps may then be repeated to produce as many cubes as are desired.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A mandoline slicer, comprising:

a frame having a pair of opposing frame sidewalls;

a platen forming a slicing ramp at a proximal portion of the slicer and carried on the frame between the pair of opposing frame sidewalls, the platen having a proximal end and a distal end;

a runout plate positioned at a distal portion of the slicer and between the opposing frame sidewalls, the runout plate having a main blade positioned adjacent the platen, the distal end of the platen being moveable to a plurality of positions to define a plurality of cutting thicknesses between the distal end of the platen and the main blade, the runout plate further having a plurality of cubing blade slots formed between the main blade and the distal end of the slicer;

a cubing blade assembly supported between the pair of opposing frame sidewalls and below an upper surface of the runout plate, the cubing blade assembly having a first set of cubing blades configured to be selectively movable between a first position in which the first set of cubing blades extends through at least some of the plurality of cubing blade slots, and a second position in which the first set of cubing blades is retracted below the upper surface of the runout plate;

a first selector knob positioned on one of the opposing frame sidewalls, the first selector knob being connected to the cubing blade assembly and operable to move the first set of cubing blades between the first position and the second position;

the first set of cubing blades each further having a first sharp edge facing toward the proximal end of the slicer, and a second sharp edge facing toward the distal end of the slicer, wherein when a food item is moved across the first set of cubing blades toward the distal end of the slicer the food item is cut by the first sharp edge, and when the food item is rotated 90 degrees on the platen and moved across the second set of cubing blades toward the proximal end of the slicer the food item is cut by the second sharp edge;

the platen further having a plurality of julienne blade slots arranged in a row and positioned between the main blade and the proximal end of the slicer;

a julienne blade assembly supported between the pair of opposing frame sidewalls and below an upper surface of the platen, the julienne blade assembly having a first set of julienne blades configured to be selectively movable within a first channel between a deployed position in which the first set of julienne blades extends through at least some of the plurality of julienne blade slots, and a stowed position in which the first set of julienne blades is retracted below the upper surface of the platen and a second set of julienne blades configured to be selectively movable within a second channel between a deployed position in which the second set of julienne blades extends through at least some of the plurality of julienne blade slots, and a stowed position in which the second set of julienne blades is retracted below the upper surface of the platen; and a second selector knob positioned on one of the opposing frame sidewalls, the second selector knob being connected to the julienne blade assembly and operable to move the first set of julienne blades and the second set of julienne blades between the deployed position and the stowed position;

whereby the first set of cubing blades is moveable between the first and second positions independently of the movement of the first set of julienne blades between the stowed and deployed positions.

2. The mandoline slicer of claim 1, wherein the cubing blade assembly further comprises a second set of cubing blades configured to be selectively movable between the second position in which the second set of cubing blades extends through at least some of the plurality of cubing blade slots, and a third position in which the first set of cubing blades and the second set of cubing blades are retracted below the upper surface of the runout plate.

3. The mandoline slicer of claim 2, wherein the first selector knob is movable between a locked position and an unlocked position, the cubing blade assembly being movable between the first position, the second position, and the third position when the selector knob is in the unlocked position.

4. The mandoline slicer of claim 3, wherein the first selector knob further comprises a stem supported within a hole formed in one of the opposing frame sidewalls.

5. The mandoline slicer of claim 4, wherein the stem further comprises at least one projection and the hole comprises at least one notch, the projection being received within the notch when the first selector knob is in the locked position.

6. The mandoline slicer of claim 3, further comprising a pusher attachable to one of the opposing frame sidewalls, the pusher having a pusher support, a pusher grip defining an interior cavity and surrounding the pusher support, a pusher plate vertically moveable within the interior cavity, and a plurality of downwardly-depending spikes mounted within the pusher grip and extending through the pusher plate, whereby the pusher plate is vertically moveable with respect to both the pusher grip and the spikes.

7. The mandoline slicer of claim 6, wherein the pusher grip is rotatable with respect to the pusher support, and further wherein the pusher grip and pusher support comprise complementary abutting surfaces to limit the rotational path of travel to 90 degrees.

8. The mandoline slicer of claim 7, wherein the complementary abutting surfaces comprise a plurality of abutments formed on an interior surface of the pusher grip within the pusher grip cavity, and a pair of diametrically opposing stops formed on an outer surface of the pusher support.

9. A mandoline slicer, comprising:

a frame having a pair of opposing frame sidewalls extending from a proximal end of the slicer to a distal end of the slicer;

a main blade spanning between the pair of opposing frame sidewalls;

a runout plate extending from the main blade toward the distal end of the slicer, the runout plate having a plurality of cubing blade slots extending between an upper surface and a lower surface of the runout plate;

a platen forming a slicing ramp between the main blade and the proximal portion of the slicer and positioned between the pair of opposing frame sidewalls, the platen having a proximal end and a distal end, the platen being positioned to define a gap between the main blade and the distal end of the platen;

a platen support having a forward end adjacent the main blade and a rearward end at the proximal end of the slicer, and a left side and an opposing right side between the forward end and the rearward end, the platen support being positioned beneath the platen and providing support for the platen, the platen support further being coupled to the opposing frame sidewalls at the forward end of the left side, the forward end of the right side, the rearward end of the left side, and the rearward end of the right side to restrict the platen support against longitudinal movement;

a height adjuster coupled to the opposing frame sidewalls for longitudinal movement between the proximal end and the distal end of the slicer while being constrained against vertical movement, the height adjuster and platen support having complementary engaging surfaces whereby longitudinal movement of the height adjuster causes vertical movement of the platen support at both the forward end and the rearward end, the platen being moveable with respect to a position of the main blade to define a slicing thickness for a food item traveling from the proximal end of the slicer toward the distal end of the slicer;

a pusher attachable to one of the opposing frame sidewalls, the pusher having a pusher support, a pusher grip defining an interior cavity and surrounding the pusher support, and a pusher plate vertically moveable within the interior cavity;

a cubing blade assembly supported between the pair of opposing frame sidewalls and below the upper surface of the runout plate, the cubing blade assembly having a first set of cubing blades configured to be selectively extended through at least some of the plurality of cubing blade slots in the runout plate or retracted below the upper surface of the runout plate;

the first set of cubing blades when extended through the cubing blade slots being positioned on the runout plate such that the pusher grip is rotatable on the runout plate between the first set of cubing blades and the distal end of the slicer; and the first set of cubing blades each further having a first sharp edge facing toward the proximal end of the slicer, and a second sharp edge facing toward the distal end of the slicer, wherein when a food item is moved across the first set of cubing blades toward the distal end of the slicer the food item is cut by the first sharp edge, and when the food item is rotated 90 degrees on the platen and moved across the second set of cubing blades toward the proximal end of the slicer the food item is cut by the second sharp edge.

10. The mandoline slicer of claim 9, wherein the cubing blade assembly further comprises a second set of cubing blades configured to be selectively extended through at least some of the plurality of cubing blade slots in the runout plate or retracted below the upper surface of the runout plate, the first set of cubing blades having a larger number of blades than the second set of cubing blades.

11. The mandoline slicer of claim 10, wherein the cubing blade assembly further comprises a first selector knob, the first selector knob being movable between a locked position and an unlocked position, the cubing blade assembly being movable to selectively extend and retract the first set of cubing blades and the second set of cubing blades when the first selector knob is in the unlocked position.

12. The mandoline slicer of claim 11, wherein the cubing blade assembly further comprises an axle, the axle being supported by the frame sidewalls for rotational movement of the axle and the blade assembly about the axle.

13. The mandoline slicer of claim 12, wherein the first selector knob further comprises a stem having at least one projection, the projection being configured to engage a notch formed in the frame sidewall when the first selector knob is in the locked position.

14. The mandoline slicer of claim 12, wherein the pusher further comprises a plurality of downwardly-depending spikes mounted within the pusher grip and extending through the pusher plate, whereby the pusher plate is vertically moveable with respect to both the pusher grip and the spikes.

15. The mandoline slicer of claim 14, wherein the pusher grip is rotatable with respect to the pusher support, and further wherein the pusher grip and pusher support comprise complementary abutting surfaces to limit the rotational path of travel to 90 degrees.

16. The mandoline slicer of claim 15, wherein the complementary abutting surfaces comprise a plurality of abutments formed on an interior surface of the pusher grip within the pusher grip cavity, and a pair of diametrically opposing stops formed on an outer surface of the pusher support.

17. The mandoline slicer of claim 9, wherein the platen support comprises a pair of outwardly extending forward tabs and a pair of outwardly extending rearward tabs, the pair of outwardly extending forward tabs and the pair of outwardly extending rearward tabs each engaging the frame to restrict the platen support against longitudinal movement.

18. The mandoline slicer of claim 17, wherein the frame comprises a first pair of opposing grooves and a second pair of opposing grooves, each one of the tabs in the pair of outwardly extending forward tabs and the pair of outwardly extending rearward tabs being received in a corresponding one of the grooves from among the first pair of opposing grooves and a second pair of opposing grooves.

19. The mandoline slicer of claim 18, wherein the platen further includes a plurality of julienne blade slots positioned between the main blade and the proximal end of the slicer, and wherein the mandoline slicer further comprises a julienne blade assembly supported between the pair of opposing frame sidewalls and below an upper surface of the platen, the julienne blade assembly having a first set of julienne blades configured to be selectively movable between a deployed position in which the first set of julienne blades extends through at least some of the plurality of julienne blade slots, and a stowed position in which the first set of julienne blades is retracted below the upper surface of the platen, wherein the cubing blade assembly is moveable between the first and second positions independently of the movement of the julienne blade assembly between the stowed and deployed positions.

20. The mandoline slicer of claim 19, further comprising:

a first selector knob positioned on one of the opposing frame sidewalls, the first selector knob being connected to the cubing blade assembly and operable to move the first set of cubing blades between the first position and the second position; and a second selector knob positioned on one of the opposing frame sidewalls, the second selector knob being connected to the julienne blade assembly and operable to move the first set of julienne blades between the deployed position and the stowed position.

* * * * *